US009951539B2

(12) United States Patent
Roodenburg et al.

(10) Patent No.: US 9,951,539 B2
(45) Date of Patent: Apr. 24, 2018

(54) MODULAR DRILLING RIG SYSTEM AND METHOD FOR ASSEMBLING THE SAME

(71) Applicant: ITREC B.V., Schiedam (NL)

(72) Inventors: Joop Roodenburg, Delft (NL); Diederick Bernardus Wijning, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 14/786,494

(22) PCT Filed: Apr. 25, 2014

(86) PCT No.: PCT/NL2014/050269

§ 371 (c)(1),
(2) Date: Oct. 22, 2015

(87) PCT Pub. No.: WO2014/178712

PCT Pub. Date: Nov. 6, 2014

(65) Prior Publication Data

US 2016/0060893 A1 Mar. 3, 2016

(30) Foreign Application Priority Data

Apr. 29, 2013 (NL) ..... 1040189
May 3, 2013 (NL) ..... 2010755

(51) Int. Cl.
*E21B 7/02* (2006.01)
*E04H 12/34* (2006.01)
(Continued)

(52) U.S. Cl.
CPC ..... *E04H 12/345* (2013.01); *E04H 12/187* (2013.01); *E21B 7/02* (2013.01); *E21B 15/00* (2013.01); *E21B 15/003* (2013.01)

(58) Field of Classification Search
CPC ..... E04H 12/345; E04H 12/187; E21B 15/00; E21B 15/003; E21B 7/02
(Continued)

(56) References Cited

U.S. PATENT DOCUMENTS 2,922,501 A * 1/1960 Wilson ..... E21B 15/00 52/118
3,033,527 A * 5/1962 Wilson ..... E21B 15/00 254/323

(Continued)

*Primary Examiner* — Brent W Herring
(74) *Attorney, Agent, or Firm* — Birch, Stewart, Kolasch & Birch, LLP

(57) ABSTRACT

The invention relates to a modular drilling rig system comprising multiple components, which system is transfigurable between a transport mode and an operational mode, and comprises: a. a drilling rig mast which is positionable in a vertical orientation; b. a base structure adapted to be positioned on a surface near the well center to support the drilling rig mast thereon, wherein the base structure comprises two elongated members that are connected to each other by a cross beam; c. a displacement system to displace the drilling rig with respect to the surface in a horizontal direction; wherein the displacement system is configured to displace the two elongated members of the base structure together in order to displace the drilling rig, and is configured such that the two elongated members can be displaced with respect to each other when the two elongated members are not connected to each other.

20 Claims, 27 Drawing Sheets

(51) Int. Cl.
*E21B 15/00* (2006.01)
*E04H 12/18* (2006.01)

(58) Field of Classification Search
USPC ..... 52/123.1
See application file for complete search history.

(56) References Cited

U.S. PATENT DOCUMENTS 3,228,151 A 1/1966 Woolslayer et al.
5,921,336 A 7/1999 Reed
6,581,525 B2 * 6/2003 Smith ..... B62D 55/00 104/96
6,581,698 B1 * 6/2003 Dirks ..... E21B 19/20 166/77.52
6,857,483 B1 * 2/2005 Dirks ..... E21B 19/20 166/77.51
7,306,055 B2 * 12/2007 Barnes ..... E21B 7/02 175/122
8,671,626 B1 * 3/2014 Marty ..... E21B 15/04 175/85
8,925,658 B2 * 1/2015 Bryant ..... E21F 13/006 180/6.48
9,004,203 B2 * 4/2015 Smith ..... B62D 57/02 180/8.1
9,045,178 B2 * 6/2015 Smith ..... B62D 57/02
9,073,588 B1 * 7/2015 Squires ..... B62D 57/032
9,096,282 B2 * 8/2015 Smith ..... B62D 57/02
9,132,871 B2 * 9/2015 Crisp ..... B62D 57/02
9,168,962 B2 * 10/2015 Trevithick ..... B62D 57/02
9,212,524 B2 * 12/2015 Buckingham ..... E21B 15/006
9,359,784 B2 * 6/2016 Trevithick ..... E21B 15/00
9,518,429 B2 * 12/2016 Fortson ..... E21B 15/003
9,708,861 B2 * 7/2017 Reddy ..... E21B 15/003
2003/0172599 A1 * 9/2003 Frink ..... E21B 15/003 52/116
2011/0079568 A1 * 4/2011 Mau ..... B66C 23/78 212/296
2012/0167485 A1 * 7/2012 Trevithick ..... E21B 15/00 52/112
2014/0054097 A1 * 2/2014 Bryant ..... E21F 13/006 180/8.1
2014/0158342 A1 * 6/2014 Smith ..... B62D 57/02 166/85.1
2014/0231098 A1 * 8/2014 Buckingham ..... E21B 15/003 166/379
2015/0114717 A1 * 4/2015 Fortson ..... E21B 15/003 175/57
2016/0017628 A1 * 1/2016 Trevithick ..... E21B 15/00 52/119
2016/0130877 A1 * 5/2016 Fortson ..... E21B 7/023 521/121

* cited by examiner

MODULAR DRILLING RIG SYSTEM AND METHOD FOR ASSEMBLING THE SAME

The present invention relates to a modular drilling rig system and a method for assembling such a modular drilling rig system.

Modular drilling rig systems have been used in the oil and gas industry, both in offshore drilling industry and on land, for a considerable time. The advantage of a modular drilling rig system is that the system is transfigurable between a transport mode in which the components of the system are transportable by vehicles and an operational mode in which the components of the system are assembled to a drilling rig which is adapted to drill into a well centre in the ground.

A challenge when designing modular drilling rigs is to keep the number of components small to be able to quickly assemble the rig and at the same time keep the size and weight of the components small so that the components can be transported by vehicles, preferably 'normal' vehicles, e.g. vehicles used to transport standard-size containers.

It is therefore an object of the invention to provide a modular drilling rig system which is easy to transfigure between the transport mode and the operational mode and can easily be transported by vehicles.

According to a first aspect of the invention this object is achieved by a modular drilling rig system according to claim 1.

An elongated member of the base structure usually consists of multiple components, so that the combination thereof is too heavy to be handled by a vehicle or forklift truck and the prior art drilling rig systems require a special lifting device in the form of a crane to handle the elongated members in order to assemble or disassemble the drilling rig.

An advantage of the modular drilling rig system is that the displacement system is able to move the elongated members independently from each other, so that the displacement system can be used to assemble and disassemble the base structure of the drilling rig instead of a special lifting device capable of handling an elongated member. This will make the transfiguration between the transport mode and the operational mode easier.

Preferably, the displacement system and the base structure are configured such that the two elongated members can be displaced with respect to each other when the two elongated members are not connected to each other by the cross beam in order to connect the two elongated members to each other by the cross beam.

In an embodiment, axial ends of the cross beam are connectable to respective sides of the two elongated members of the base structure.

In unpublished patent application PCT/NL2013/050132 of the same applicant, the base structure comprises a cross beam to which relatively large elongated beams are connected with their respective axial ends to form a C- or H-frame in plan view. This base structure thus does not disclose elongated members as in the first aspect of the invention, at least not elongated members that can be displaced independently from each other by the displacement system.

In an embodiment, the elongated members and the cross beam form a C-arrangement when seen from above. The configuration of the base structure forming a C-arrangement when seen from above is advantageous as the well centre is freely accessible, e.g. to position a BOP (Blow Out Preventer). Another advantage is that the drilling rig system may be allowed to move away from the well centre, e.g. to move to another well centre nearby. This is in particular advantageous when the base structure is provided with a displacement system as described in application PCT/NL2013/050026 of the same applicant, herewith incorporated by reference. In prior art drilling rig systems, base structures supporting the drilling rig mast are applied which surround the well centre entirely. Also, it is known to position the drawworks or the pipe loader adjacent the well centre, opposite to the drilling rig mast. Another advantage of the C-arrangement is the increased safety: the sensitive well centre cannot be disturbed during assembly and installation of the drilling rig system.

Preferably, the components of the modular transfigurable drilling rig system, at least of the base structure and of the mast, have dimensions that allow the components to be transported on vehicles, e.g. trucks, e.g. on trailers, over land. In particular, the maximum dimensions of most components, e.g. support beams, elongated members, displacement devices, mast sections, pipe loader etc. correspond to those of standard ISO freight containers. Possibly one or more components are provided with ISO corner fittings to secure the component during transportation and possibly also for assembly of the rig. Even more preferably, the components also have a limited weight per component, e.g. a maximum weight per component of 25 tons. Such a limited weight may facilitate transport and enable a quick assembly and disassembly of the drilling rig according to the invention.

The modular transfigurable drilling rig system according to the present invention is transfigurable into an operational mode in which the components are assembled to form a drilling rig. In the operational mode the drilling rig of the invention is preferably suitable for drilling processes for the extraction of a natural resource such as ground water, natural gas, or petroleum, for the injection of a fluid from surface to a subsurface reservoir or for subsurface formations evaluation or monitoring. The hole drilled in the earth's surface through which the natural resources are being extracted is called the well centre. In practice, multiple well centres may be present at a single drilling site.

An important component of the modular transfigurable drilling rig system is a drilling rig mast, having a top end and a foot. In the operational position the mast is positioned vertically above the well centre to perform drilling activities. In an embodiment, the drilling rig mast is movable between a substantially horizontal connecting position and an operational position. Possibly, the drilling rig mast is composed of multiple transportable mast sections, for example 2-4 sections, preferably three sections, at least including a foot or lower section forming the foot of the drilling rig mast and a top section forming the top of the drilling rig mast. The mast sections need to be assembled end-to-end, and are connected to form a drilling rig mast having a top end and a foot.

In an embodiment, the system includes a pedestal adapted to be—in a substantially horizontal connecting position thereof—pivotally connected at a lower end thereof to said base structure, preferably to the elongated members, about a pedestal pivot axis; which pedestal is operable to pivot between the substantially horizontal connecting position and a substantially vertical operational position; which pedestal is adapted to be—in the substantially horizontal connecting position—connected to the foot of the drilling rig mast and adapted to—in the substantially vertical operational position—support the drilling rig mast above the well centre.

In an embodiment, the system includes a drive assembly to pivot the drilling rig mast, possibly the connected pedestal and drilling rig mast, as a unit between the substantially horizontal connecting position and the substantially vertical operational position, such that in the vertical operating position the drilling rig mast is positionable above the well centre The assembly of a drilling mast comprising a top section, a middle section and a lower section may be as follows. After the pedestal is connected to the base structure, the lower mast section is supplied, e.g. by a trailer of a road vehicle, and connected to the pedestal. The drive assembly is then operated to raise the lower mast section from the trailer. The middle section is subsequently supplied on a trailer of a vehicle in lying condition. In order to align the upper end of the lower section with the lower end of middle section the lower mast section has been tilted downward to obtain alignment. Then the connection is established only at the adjoining top facing corners or sides of these lower and middle mast sections, this connection forming a temporary hinge. The lower mast section has hooks at the top facing corners, while the middle mast section having mating members to establish a hinged connection. Then the lower mast section is raised again by operating the drive assembly to obtain full alignment of the lower and middle mast sections so that their lower corners also meet and the lower and middle mast sections are then raised somewhat further so that the mast clears the trailer which is then driven away. It is noted that the lower corners of the adjoining lower and middle mast sections are connected yet, as will be explained below.

The middle mast section, and possibly also other mast sections of the mast or portions thereof, has, as is preferred, a c-shaped cross-section with three latticed sides having vertical longitudinal columns at their corners and a lattice framework there between. The middle mast section has one open side, said open side facing downwards when the mast is held in generally horizontal position relative to the base structure. The open side provides an opening to allow for a top drive to be brought into the space within the contour of the mast section, e.g. as will be explained or e.g. as will be explained with reference to the third aspect of the invention below.

Before the top mast section is connected to the mast, it is envisaged that the top drive is supplied by a vehicle in horizontal or lying condition as is preferred to facilitate the transportation thereof. As preferred, the top drive lies on a vehicle trailer which is parked underneath the middle mast section that is now held in generally horizontal position.

Subsequently, the mast is lowered by operation of the drive assembly, so that the middle section comes to rest on the trailer. The lower and middle sections assume an angled orientation relative to one another, interconnected by the temporary hinge as explained above. Now the middle section is horizontal on the trailer.

As the open side of the middle mast section is directed downwards at this stage, the top drive—still lying on the trailer—comes into the space defined by the contour of the middle mast section. The top drive is then connected to the middle mast section, e.g. to one or more guide rails extending longitudinally along the middle mast section. For example the middle mast section includes one of more longitudinal guide rails equipped with one or more trolleys thereon, the top drive being connected to the trolley or trolleys, e.g. by bolts. It will be appreciated that another connection arrangement, possibly a merely temporary fastening by slings or ropes, is also possible between the top drive and the mast section.

Subsequently, the lower mast section is raised so that the middle section becomes fully aligned again with the lower mast section, and now the lower corners of these lower and middle sections are securely interconnected, e.g. by locking pins or bolts. Raising lower mast section entails raising the middle mast section and thereby lifting the top drive from the trailer which can then depart.

The top mast section may subsequently be supplied by a vehicle. This top section is preferably connected to the middle mast section in the same way as the connection between the middle mast section and the lower mast section, so that the completed mast can be raised to clear from the trailer which then departs.

Possibly, drilling equipment such as top drive, crown block and travelling block are integrated into one or more of the mast sections for transportation as integrated items. Preferably, the drive assembly is adapted to pivot the connected pedestal and drilling rig mast composed from said mast sections as a unit between the substantially horizontal connecting position and the vertical operational position.

In an alternative embodiment, the drive assembly is adapted to position the drilling rig mast in a position intermediate the substantially horizontal connecting position and the vertical operational position, and preferably the drawworks are used to lift the top drive to a desired height, such that subsequent tilting of the drilling rig mast to the vertical operational position will bring the suspended top drive into the space within the contour of the drilling rig mast.

In an embodiment, not only the top drive is assembled into the drilling rig mast as described above, but a top drive assembly including the top drive and at least one additional component such as drag chains, guide rails, trolley etc. is assembled into the drilling rig mast as a unit.

The well centre above which the drilling rig is positioned in the operational mode can be positioned on land or in the water. The drilling rig mast is in the operation position to be provided substantially above the well centre. To this end, a base structure is provided which—in the operational mode—is adapted to be positioned on a surface near the well centre. The base structure is provide to support the drilling rig mast thereon. This surface can be the ground or earth's surface, but can alternatively be an end of a cantilever, or a deck of a vessel, etc. It is noted that whilst the rig according to the invention is primarily proposed for land based drilling activities, e.g. oil, gas (e.g. shale gas), geothermal drilling activities, the same rig may also be employed for drilling offshore. The surface is then formed by a platform, drilling vessel, etc.

The base structure according to the invention is composed of at least three main base structure components, which are preferably to be transported as separate components: a cross beam (or plate) adapted to be positioned on the surface near the well centre, and at least two elongated members. Preferably, the main base structure components are 40 foot long as an ISO freight container. The elongated members are adapted to be placed on the surface adjacent the cross beam, which elongated members may each be connectable to the cross beam to form a C-arrangement when seen from above, with the legs of the C at the side remote from the well centre, such that said elongated members extend side-by-side with a spacing there between. Preferably, each elongated member has a side, and the cross beam has two axial end faces that are provided with two sets of connector members each for connecting the cross beam to the side of an elongated member. A main base structure component such as the elongated members may be composed of two parts that are individually transportable to keep the weight of the components below a predetermined maximum. The cross beam is preferably made out of one piece, i.e. can not easily be disassembled into multiple components for individual transportation.

Optionally, the elongated members further comprise two parallel support beams adapted to be positioned on the surface perpendicular to the cross beam and adjacent the well centre. These support beams are preferably continuations of the elongated members. These support beams may be embodied integral with the elongated members. In all, the base structure now forms a H-arrangement when seen from above, with legs at the side remote from the well centre, and legs at the side of the well centre. Preferably, the legs at the side remote from the well centre are longer than the legs at the side of the well centre.

According to an embodiment of the invention, a pedestal is provided which is adapted to—in the substantially vertical operational position—support the drilling rig mast above the well centre. In order to allow the drilling rig system according to the present invention to be transfigurable between a transport mode and an operational mode, the pedestal is operable to pivot between a substantially horizontal connecting position and the substantially vertical operational position. The pedestal is adapted to be—in a substantially horizontal connecting position thereof—pivotally connected to said base structure, preferably to the elongated members, about a pedestal pivot axis. Yet alternatively, it is also conceivable that the pedestal is connected to the cross beam of the base structure, or to yet another component of the base structure. Preferably, the pedestal pivot axis is provided at a fixed, stationary position on the base structure. This position is preferably an elevated position.

Preferably, the pedestal is connected to the base structure at a lower end thereof, wherein 'lower' is defined as the lower portion of the pedestal when it is in a substantially vertical operation position. In the substantially horizontal connecting position the pedestal is also adapted to be connected to the foot of the drilling rig mast, preferably at an upper end thereof, wherein 'upper' is defined as the upper portion of the pedestal when it is in a substantially vertical operation position. In an embodiment, the foot of the drilling rig mast comprises a mast connection point or member to be connected pivotally to the pedestal pivot axis on the base structure, preferably the elongated members.

In a preferred embodiment, the pedestal comprises an arm, adapted to be—in the substantially horizontal connecting position—pivotally connected at a lower end thereof to said base structure, and a cantilevered mast support connected to an upper end of the arm, extending upwards in the substantially horizontal connecting position of the pedestal and extending forward of the arm in the substantially vertical operational position, adapted to be—in the substantially horizontal connecting position—connected to the foot of the drilling rig mast and adapted to—in the substantially vertical operational position—support the drilling rig mast above the well centre. The connection with the foot of the drilling rig mast preferably is a fixed one: it is not necessary for this connection to be pivotable. Hence, the pedestal is essentially shaped as an "L", wherein the longer leg of the L forms the arm, and the short leg forms the cantilevered mast support. Preferably, the pedestal is formed as a one-piece component. Possibly, the pedestal comprises two parallel arms, which are possibly interconnected, and a cantilevered mast support which is supported by the arms, and possibly formed integral with the one or more arms. The length of the arm preferably allows the provision of a BOP below the cantilevered mast support in the operational position of the drilling rig.

The drive assembly to raise and lower the connected pedestal and drilling rig mast preferably engages on the pedestal. Alternatively, it is also conceivable that the drive assembly engages on the (foot of the) drilling rig mast, e.g. in case no pedestal is present.

Preferably, the drive assembly includes one or more long telescopic hydraulic jacks, e.g. two hydraulic jacks extending diagonally from the pedestal or (foot of the) drilling mast to the surface. Due to the mechanical construction, it is preferred that the drive assembly engages on the pedestal and not on the drilling rig mast, as the pedestal is of a much more robust configuration.

The modular transfigurable drilling rig system of the invention further comprises a pipe loader for loading pipes such as drill pipes and/or risers and/or casings into the drilling rig mast. Preferably, the pipe loader is embodied as a compact tubular handling apparatus, which can be transported in a single container, as available by the applicant.

As indicated previously, the inventive drilling rig system comprises a base structure wherein the elongated members extend side-by-side with a spacing there between. According to an embodiment, the spacing is dimensioned to receive a vehicle carrying at least a foot portion of the drilling rig mast in its substantially horizontal connecting position, such that the foot of the drilling rig mast is arranged between the elongated members and connectable to the pedestal in its substantially horizontal connecting position. In addition, the spacing is dimensioned such that after the unit formed by the connected pedestal and drilling rig mast has pivoted to the substantially vertical operational position, the pipe loader can be received. Hence, upon assembling the drilling rig system the space between the elongated members is used to assemble the drilling rig mast, and after the mast is in its operational position, the same space between the elongated members is used to load and unload tubulars using a pipe loader. This has the advantage that the well centre is kept clear both during the installation of the riling rig, and the movement of the drilling rig mast, and during tubular handling with the pipe loader in the operation mode of the drilling rig. This is additionally advantageous in view of safety: the sensitive well centre cannot be disturbed during assembly and installation of the drilling rig system.

Other drilling rig components of the system may include e.g. drill floor members, drawworks, a blow out preventer (BOP), a drillers cabin, pipe tubs, a pipe rack, mud pumps, shaker tanks, etc.

In a possible embodiment, the drilling rig system further comprises one or more drill floor members adapted to form a drill floor in the operational mode, said drilling floor in the operational mode being located at an elevated position above said base structure, wherein the one or more drill floor members are installed in the drilling rig mast once it is in the vertical operating position thereof. It is noted that a drill floor member may include the actual drill floor, e.g. including drill floor plates, but may also be formed by a drill floor frame member on top of or onto which floor plates or the like are to be mounted, e.g. at a later stage. For example, drill floor members that are to be present on opposite sides on the outside of the mast, above the elongated members, are hoisted onto the mast after it has been erected, or one or more drill members from part of a mast section, e.g. as hinged flaps that can be deployed in the operative position.

The provision in a drilling rig system of a pedestal and a drive assembly to pivot the connected pedestal and drilling rig mast as a unit according to the invention is advantageous as this dispenses the use of drilling drawworks for erecting the drilling rig mast. Due to the use of a pedestal which is adapted to be connected to the drilling rig mast, forming a unit which is pivoted to the vertical operating position, there is no need for modification of the drawworks so that they can be dedicated to their function in the drilling process. A disadvantage of using drawworks to pivot the drilling rig mast is that prior to being able to raise the mast the cables of the drawworks need to be reeved between a drawworks location comprising the winches and sheaves provided in the drilling rig mast prior to raising the mast. In addition, this requires the drawworks to be suitable not only to be used during drilling operations, but also to be used to raise the mast. Another disadvantage is that this installation is complex and time-consuming.

The invention allows for an efficient installation once the drilling rig mast and base structure are positioned on the surface near the well centre. Moreover, the provision of a pedestal and drive assembly according to the invention allow for an advantageous embodiment of the drilling rig, in which the drilling rig system further comprises drilling drawworks. The drilling drawworks is preferably embodied as a component which is transportable by a vehicle. In the advantageous embodiment, the drilling rig mast or the pedestal is provided with drawworks connection members adapted to connect the drawworks to the drilling rig mast or the pedestal at an elevated drawworks position. Possibly the drawworks position is spaced above the drill floor. Alternatively, the drawworks position is at the level of the cantilevered mast support of the pedestal. As such, the drawworks are no longer positioned on the ground in the drilling area, but are connected to the drilling rig mast or the pedestal in an elevated drawworks position. The thus achieved clearance of the ground in the drilling area is very advantageous during drilling operations and enables a more efficient drilling process.

The drilling drawworks may be connected to the drilling rig mast as part of a drilling drawworks assembly comprising the drilling drawworks, connection members adapted to connect the drawworks to the drilling rig mast, floor members to allow access to the drawworks, e.g. for maintenance purposes, etc.

Optionally, the pedestal with the drilling mast connected thereto is operable to move from the substantially horizontal connecting position, via the substantially vertical operational position to a tilted position beyond the vertical operating position thereof, in which position the mast is able to connect the drilling drawworks to the drilling rig mast. The drawworks are preferably presented to the drilling rig mast at an elevated position, e.g. by removing them from the vehicle, e.g. by a crane, or by using optional features of the vehicle, such as a movable floor.

Yet alternatively, the drilling rig mast may be provided with a hoist device adapted to hoist a drilling drawworks—with the mast in its vertical operational position—to the elevated drawworks position on the mast. In particular, the drilling rig mast hoist means may comprise a crane provided at the upper end of the drilling rig mast and an auxiliary jib provided adjacent the elevated drawworks position.

According to an embodiment of the invention, the driller's cabin is positioned on a drill floor member when the drill floor member is in the operational mode. Alternatively, the driller's cabin forms a unit with a drill floor element, thus forming a single unit, such that upon raising the drill floor to the elevated position, the drillers cabin is simultaneously raised to its operational position.

In an embodiment the drilling rig system is further provided with a passive locking mechanism that is adapted to lock the pedestal in its raised position, the locking mechanism comprising for example a locking bar that extends between the pedestal and the base structure.

In an embodiment the locking bar extends substantially diagonally. A lower end of the locking bar may be pivotally connected to the base structure, or the surface on which the base structure is positioned in the operational mode. An upper end of the locking bar may be connected to the pedestal or the drilling rig mast. Optionally, the locking bar is provided with a latch connecting the upper end to the pedestal in the raised position thereof, e.g. locking automatically when said position is reached.

In an embodiment the locking bar is provided with a damper, e.g. a hydraulic damper, to dampen motion of the drilling rig mast when reaching the vertical operational position.

Possibly, a guide or lifting mechanism is provided to guide and/or lift the foot of the drilling rig mast—when supplied in substantially horizontal position, e.g. lying on a trailer of a vehicle,—to the pedestal, e.g. the guide mechanism being adapted to raise said foot from its original height when lying on the trailer up to the pedestal. The lifting mechanism preferably enables the foot of the drilling rig mast to become aligned properly with the pedestal to allow their connection.

The present invention according to the first aspect also relates to a method for bringing into operational mode a modular transfigurable drilling rig system according to the invention, said method comprising the steps of:

- positioning a first elongated member on the surface near the well centre;
- connecting the cross beam to the first elongated member;
- positioning a second elongated member adjacent the combination of the first elongated member and the cross beam;
- providing a displacement system that allows to move the first and second elongated members independently from each other as long as the first and second elongated members are not connected to each other;
- moving the first and second elongated members relative to each other using the displacement system for connecting the second elongated member to the first elongated member by the cross beam;
- connecting the second elongated member to the cross beam.

According to a second aspect of the invention, a modular drilling rig system according to claim 5 is provided. In this system the passive locking mechanism is advantageously used to keep the drilling rig mast in an oblique orientation besides the 'normal' function of the passive locking mechanism to keep the drilling rig mast in the substantially vertical operational position. The base structure therefor comprises a support, e.g. in the form of support blocks to engage with the first and/or second parts of the passive locking mechanism at or near the location where the first and second parts are pivotally connected to each other. It is noted that the support, e.g. the support blocks only prevent the drilling rig mast from tilting further towards the surface due to gravity, but that the drilling rig mast is free to move to the vertical position. As long as there are no forces present moving the drilling rig mast to the vertical position, the support, e.g. the support blocks and passive locking mechanism keep the drilling rig mast in the oblique position.

In an embodiment, the oblique position is advantageously used to lift a top drive from a vehicle using a lifting device, preferably using the drawworks of the drilling rig. This is also described in relation to the third aspect of the invention, described below.

According to a third aspect of the invention, a method according to claim 6 is provided. The advantage of this method is that no difficult alignment between top drive and drilling rig mast is required as is the case in prior art systems where the top drive is picked up by the drilling rig mast in the substantially horizontal connecting position.

In an embodiment, the top drive is installed as part of a top drive assembly also including guide rails, which guide rails will be/are connected to the drilling rig mast and aligned with guide rails already present on the drilling rig mast, so that the top drive is guidable along the guide rails.

In an embodiment, the top drive assembly also includes drag chains for connecting the top drive to other drilling equipment, wherein after mechanically connecting the top drive to the drilling rig mast, the top drive is moved to a location that is nearest to the connection site of one of the drag chains, wherein subsequently the drag chain is connected to the other drilling equipment.

In an embodiment, the top drive assembly comprises a frame portion possibly including guide rails, a trolley temporarily stationary attached to the frame portion, a top drive mounted to the trolley, and a first and second drag chain for connecting the top drive to other drilling equipment such as mud pumps, controllers, etc. The first and second drag chains are connected to each other with respective ends and with said respective ends to the frame portion. The first drag chain is connected with its other end to the top drive, and the second drag chain can be connected with its other end to the top drive or first drag chain for transport and assembly purposes and can be connected at the foot of the drilling rig mast to the other drilling equipment, so that the top drive is connected to the other drilling equipment via the first and second drag chain. The trolley is configured to move along guide rails of the drilling rig mast up and down the drilling rig mast.

Such a top drive assembly has the advantage that a number of components can be assembled at a later stage and as one unit in the drilling rig mast instead of assembling them as individual components or integrating them into the drilling rig mast sections. Further, the movement of the trolley along the drilling rig mast can advantageously be used to position the drag chain for a single connection to the other drilling equipment, where prior art drilling rigs require multiple connections to be made between drag chains and/or drilling equipment and/or top drive.

In an embodiment, the top drive assembly is assembled into a mast section, e.g. a middle mast section by connecting the frame portion to the mast section such that the trolley can be guided along the guide rails already present and also possibly along the guide rails provided on the frame portion, removing the temporarily stationary connection between the trolley and the frame portion, moving the trolley including top drive and drag chains to the foot of the drilling rig mast, and connecting the second drag chain to other drilling equipment at the foot of the drilling rig mast.

The invention according to the first, second and third aspects will now be described in a non-limiting way by reference to the accompanying drawings in which like parts are indicated by like numerals, and in which.

FIGS. 1-20 depict an assembly sequence of a modular drilling rig system according to an embodiment of the invention. The sequence shows how the system is transfigured from a transport mode in which components of the system are transportable by vehicles to an operational mode in which the components are assembled to a drilling rig which is adapted to drill into a well centre in the ground. In the operational mode the drilling rig according to the invention is preferably suitable for drilling processes for the extraction of a natural resource such as ground water, natural gas or petroleum, for the injection of a fluid from the surface to a subsurface reservoir or for subsurface formations evaluation or monitoring. The hole drilled in the earth's surface through which the natural resources are being extracted is called the well centre. In practice, multiple well centres may be present at a single drilling site.

Although below the assembly sequence will be described, the disassembly sequence is also disclosed as being the assembly sequence in reverse order.

Figure 20:
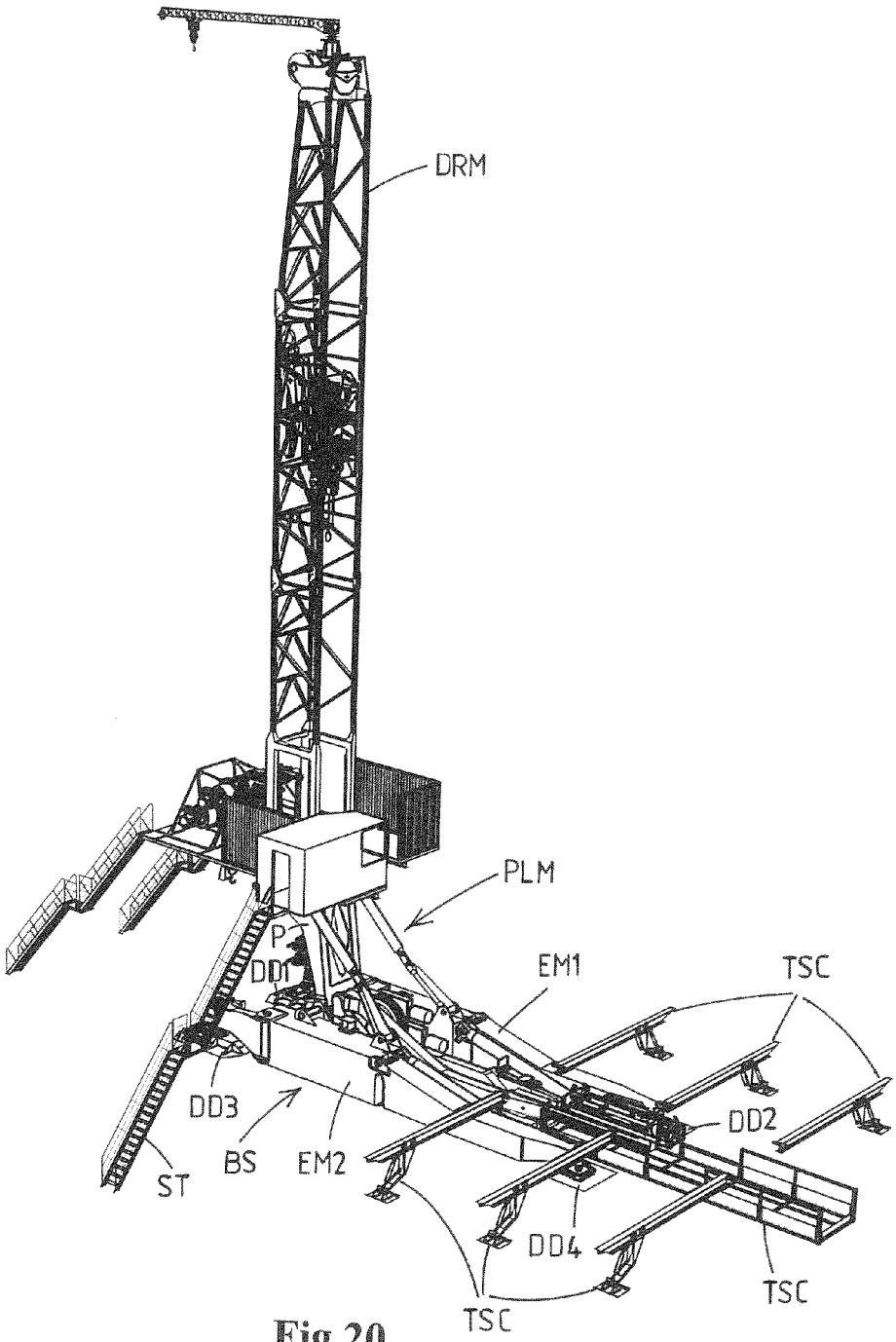

FIG. 20 depicts the drilling rig in the operational mode comprising a drilling rig mast DRM, a base structure BS positioned on a surface to support the drilling rig mast DRM thereon via a pedestal P, and a displacement system to displace the drilling rig in the operational mode with respect to the surface in a substantially horizontal direction. The displacement system can advantageously be used to position the drilling rig mast above a well centre. In case of multiple well centres being present at a single drilling site, the displacement system can be used to move the drilling rig from one well centre to another well centre.

The well centre above which the drilling rig in the operational mode can be positioned can be situated on land or in the water. The drilling rig mast is in the operational position to be provided substantially above the well centre. The base structure BS is adapted to be positioned on a surface near the well centre in order to support the drilling rig mast thereon. This surface can be the ground or earth's surface, but can alternatively be an end of a cantilever, or a deck of a vessel, etc. It is noted that whilst the rig according to the invention is primarily proposed for land based drilling activities, e.g. oil, gas (or shale gas), geothermal drilling activities, the same rig may also be employed for drilling offshore. The surface is then formed by a platform, drilling vessel, etc.

The displacement system comprises four displacement devices DD1-DD4. Two displacement devices DD1, DD2 are mounted to a first elongated member EM1 of the base structure BS, the other two displacement devices DD3, DD4 are mounted to a second elongated member EM2 of the base structure BS. The first and second elongated members EM1, EM2 are connected to each other by a cross beam CB not shown in FIG. 20, but for instance shown in FIGS. 3-6.

Figure 1:
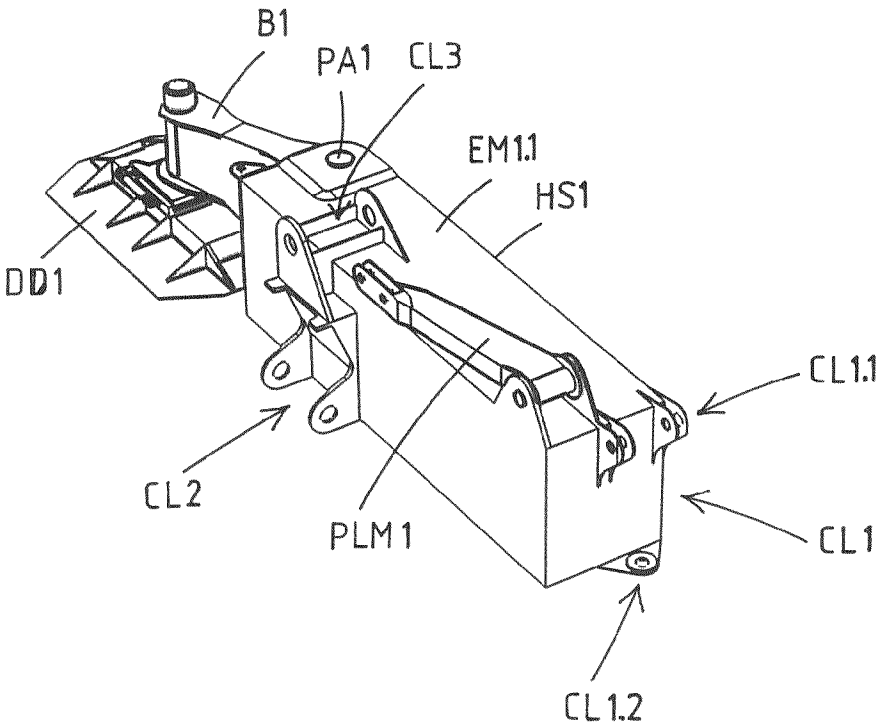
FIGS. 1-20 depict an assembly sequence of a modular drilling rig system according to an embodiment of the invention.

FIG. 1 depicts the first step of assembling the drilling rig of FIG. 20. In FIG. 1 a first part EM1.1 of the first elongated member EM1 is provided by a vehicle (not shown) as are preferably all components of the modular drilling rig system according to the invention.

The vehicle may be a truck, e.g. including a trailer, to transport the components over land. As a result, the dimensions and optionally also the weight of individual components is limited. In particular, the maximum dimensions of the components preferably corresponds to those of standard ISO freight containers. Possibly one or more components are provided with ISO corner fittings to secure the component during transportation and possibly also for assembly of the rig. Even more preferably, the components also have a limited weight per component, e.g. a maximum weight per component of 25 tons. Such a limited weight may facilitate transport and enable a quick assembly and disassembly of the drilling rig according to the invention.

The first part EM1.1 of the first elongated member EM1 preferably comprises a hollow structure HS1 to limit the weight, but with enough strength to withstand the forces and bending moments applied to the first part of the first elongated member in the operational mode. This may also apply to other components where applicable.

Figure 2:
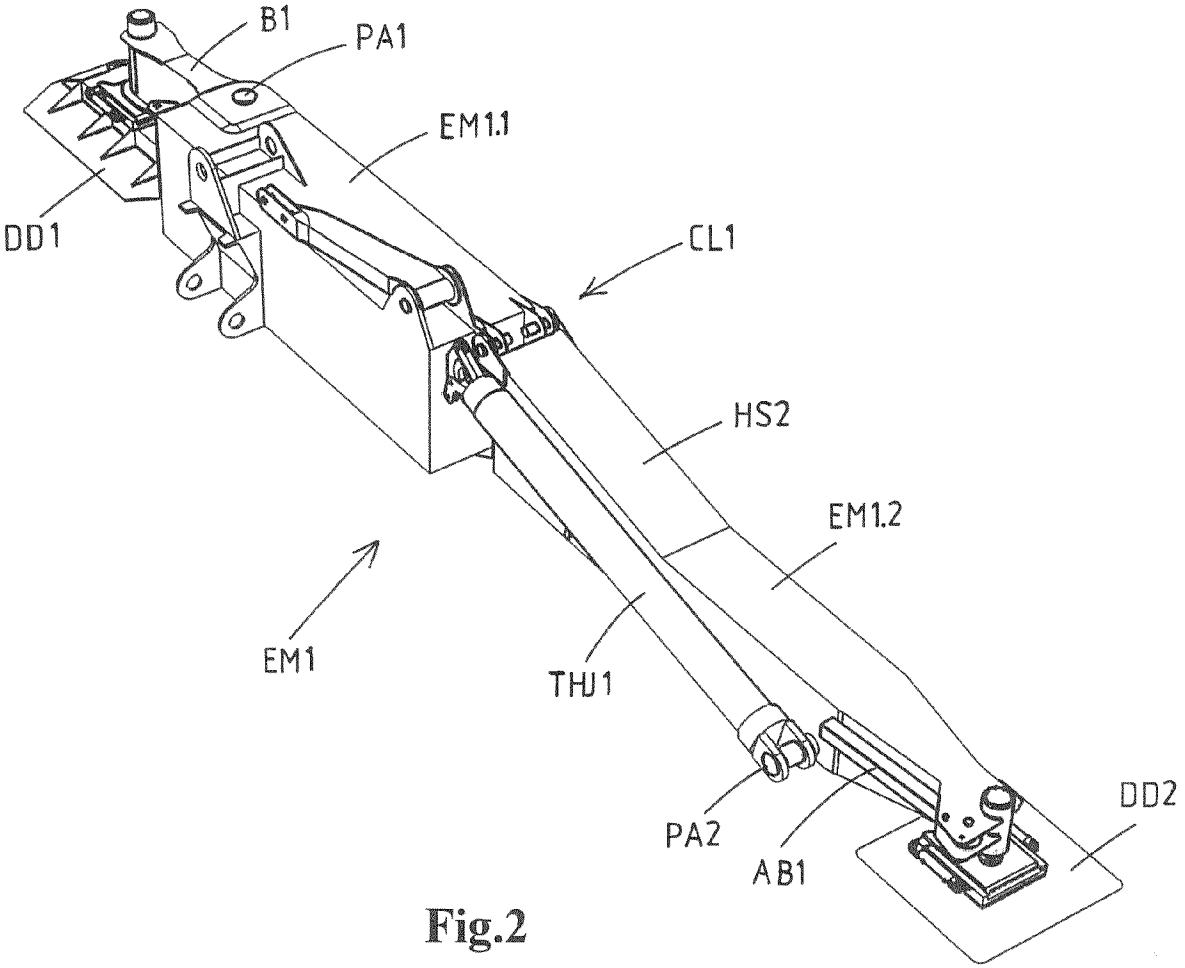
Figure 7:
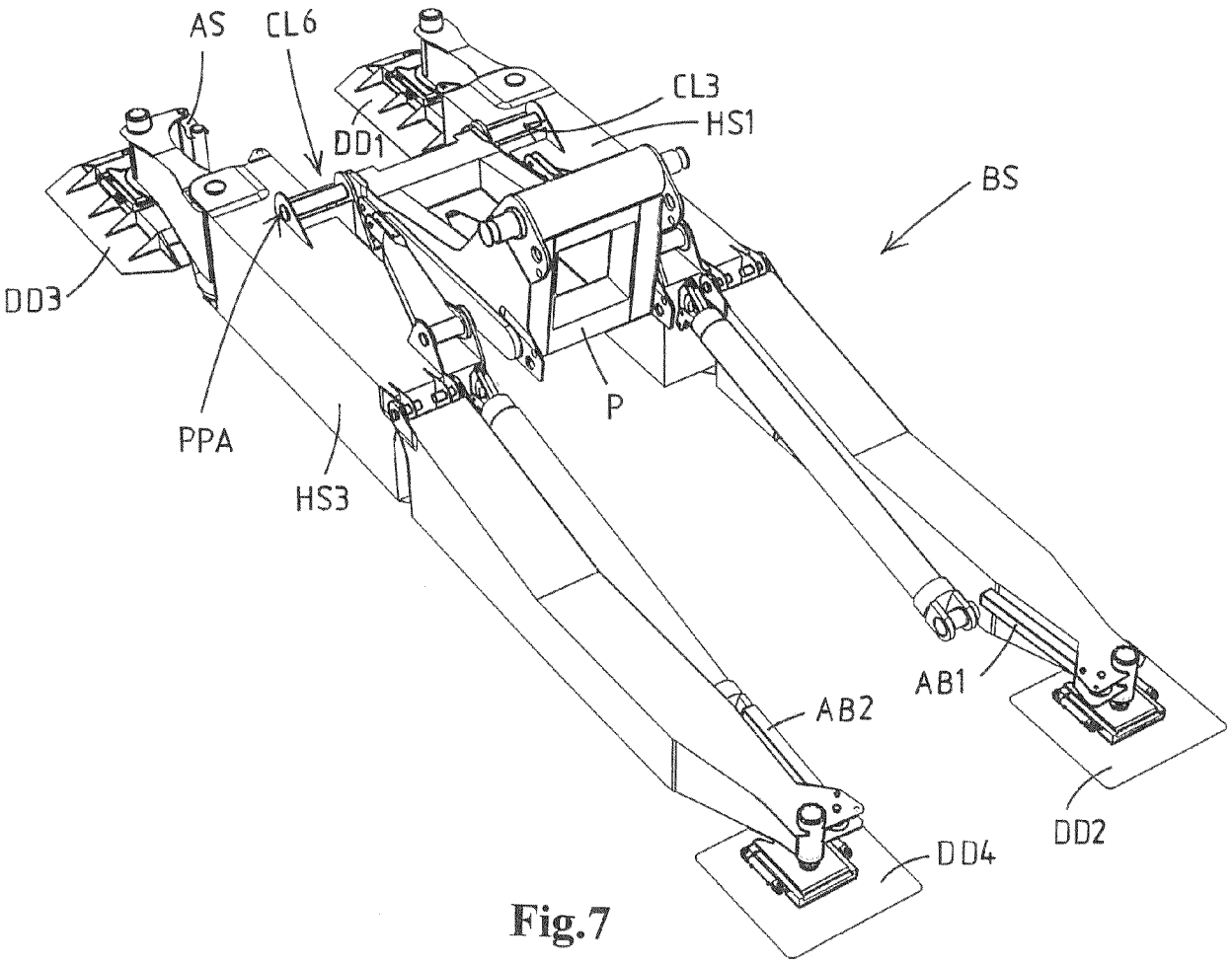

The first part EM1.1 comprises three coupling locations CL1, CL2, CL3. At coupling location CL1 a second part EM1.2 of the first elongated member EM1 will be mounted to the first part EM1.1 to form the first elongated member EM1 as can be seen in FIG. 2. At coupling location CL2 the cross beam CB connecting the first elongated member EM1 to the second elongated member EM2 will be mounted, see FIG. 3. At coupling location CL3 the pedestal P will be connected to the first elongated member EM1 as can be seen in FIG. 7.

The first part EM1.1 of the first elongated member EM1 comprises a displacement device DD1. The displacement device DD1 is part of a displacement system to move the drilling rig over the surface in a substantially horizontal mode in the operational mode. The displacement system may be a displacement system as described in non-published application PCT/NL2013/050026 of the same applicant, herewith incorporated by reference.

PCT/NL2013/050026 describes a displacement system with displacement devices comprising a displacement foot extendable and retractable in a substantially vertical direction between an extended position, in which the displacement foot is arranged on the support surface, and a retracted position, in which the displacement foot is free from the support surface. The displacement device comprises a lift actuator to move the displacement foot between the retracted position and the extended position, wherein said displacement foot comprises a lower part and an upper part, wherein said lower part is configured to be placed on the support surface, and wherein said upper part is connected to the drilling rig. The lower part is moveable with respect to the upper part in at least one substantially horizontal direction, and wherein said displacement foot comprises one or more displacement actuators to move the lower part and the upper part with respect to each other in the at least one substantially horizontal direction.

The displacement device DD1 is connected to the structure HS1 of the first part EM1.1 of the first elongated member EM1 by a support beam B1, which beam B1 is pivotably connected to the structure HS1 to allow the beam B1, and thereby the displacement device DD1, to pivot about substantially vertically oriented pivot axis PA1 between a transport position (as shown in FIG. 1) in which the dimensions of the first part EM1.1 are minimized for transport and an operational position (as shown for instance in FIG. 2). The position of the beam B1 can preferably be passively locked with respect to the structure HS1 in the transport position during transport and/or in the operational position during assembly and operation of the drilling rig to avoid the use of active energy consuming components.

The first part EM1.1 of the first elongated member EM1 also comprises a first part PLM1 of a passive locking mechanism, the function of which will be described later.

FIG. 2 depicts a subsequent step in the assembly of the drilling rig. In this figure, a second part EM1.2 of the first elongated member EM1 is provided and connected to the first part EM1.1 at coupling location CL1.

The second part EM1.2 of the first elongated member EM1 comprises a hollow structure HS2 to which a respective displacement device DD2 is mounted, which displacement device DD2 preferably has a similar construction as displacement device DD1. The first elongated member EM1 is now supported from the surface by the displacement devices DD1 and DD2.

The second part EM1.2 of the first elongated member EM1 further comprises a telescopic hydraulic jack THJ1, which in FIG. 2 is shown in a transport position in which the hydraulic jack THJ1 extends adjacent and substantially parallel to the structure HS2 to minimize the dimensions of the second part EM1.2 of the first elongated member EM1. The hydraulic jack THJ1 is pivotally connected to the structure HS2 to pivot about substantially horizontally oriented pivot axis PA2.

The second part EM1.2 of the first elongated member EM1 also comprises an alignment beam AB1 pivotally connected to the structure HS2 to aid in aligning the first elongated member EM1 with the second elongated member EM2 as will be shown later on.

Also shown in FIG. 2 is that support beam B1 has pivoted about pivot axis PA1 to the operational position.

The first part EM1.1 of the first elongated member EM1 may have been positioned on the surface by a vehicle, e.g. a truck, as shown in FIG. 1. The situation in FIG. 2 may for instance be achieved by positioning the end of the second part EM1.2 of the first elongated member EM1 that is to be connected to the first part EM1.1 at coupling location CL1 by a vehicle such that a first connection can be made at coupling location CL1.1 of coupling location CL1 (see FIG. 1), said first connection allowing the first and second part EM1.1, EM1.2 to pivot relative to each other at an upper end of the coupling location CL1. The second part EM1.2 can subsequently be positioned on the surface by the vehicle. Subsequently lifting the first and/or second part of the first elongated member EM1, e.g. using a forklift truck allows to make a second connection at coupling location CL1.2 of coupling location CL1 between the first and second part EM1.1, EM1.2, thereby rigidly connecting the first and second part EM1.1, EM1.2 together.

Figure 3:
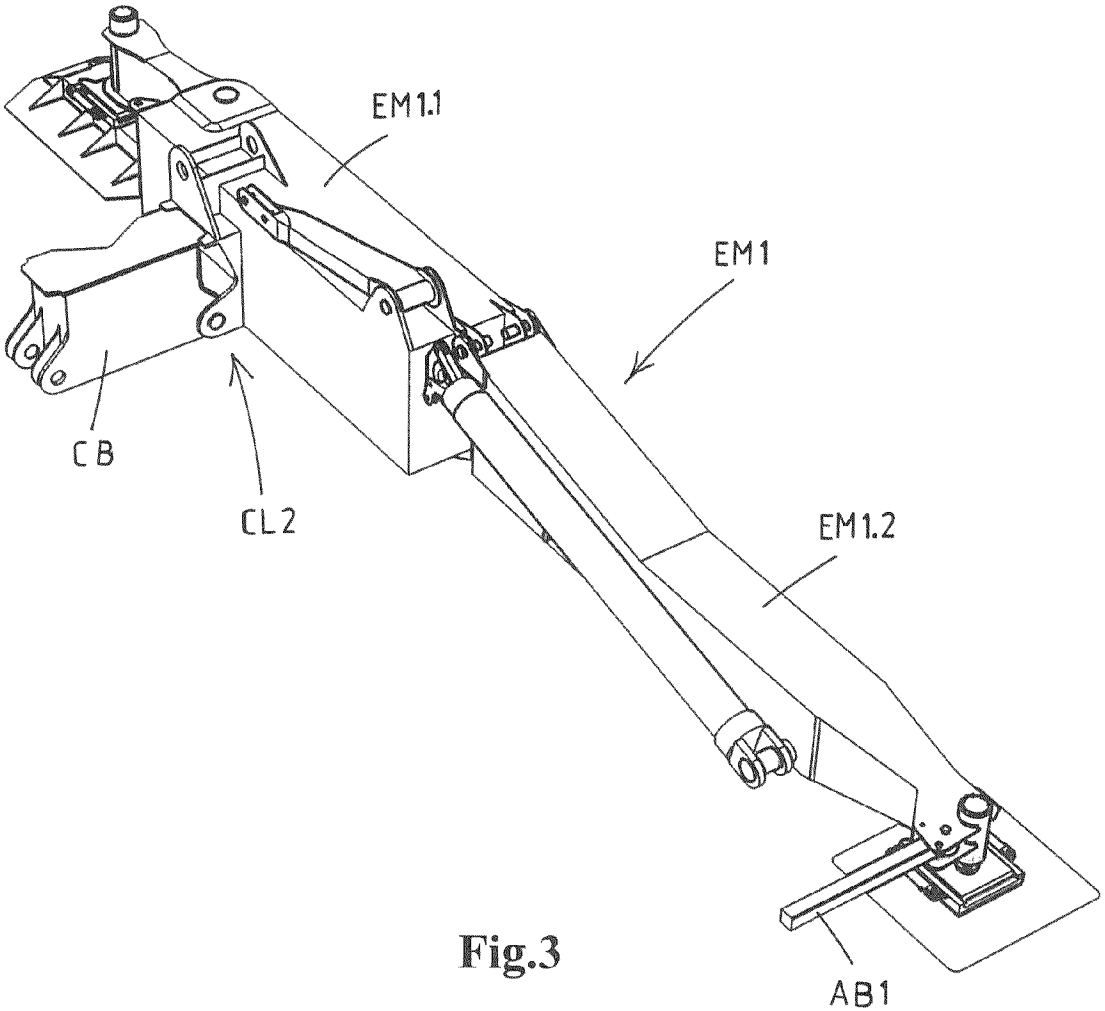

In FIG. 3 the cross beam CB configured to connect the first and second elongated members EM1, EM2 together is connected to elongated member EM1 at coupling location CL2. This may be achieved in a practical manner by lifting the cross beam with a forklift truck and subsequently connecting an axial end of the cross beam CB to a side of the first part EM1.1 at coupling location CL2.

In FIG. 3 the aligning beam AB1 is also pivoted to an aligning position compared to FIG. 2 to aid in aligning the first and second elongated members EM1, EM2, as will be explained later.

Figure 4:
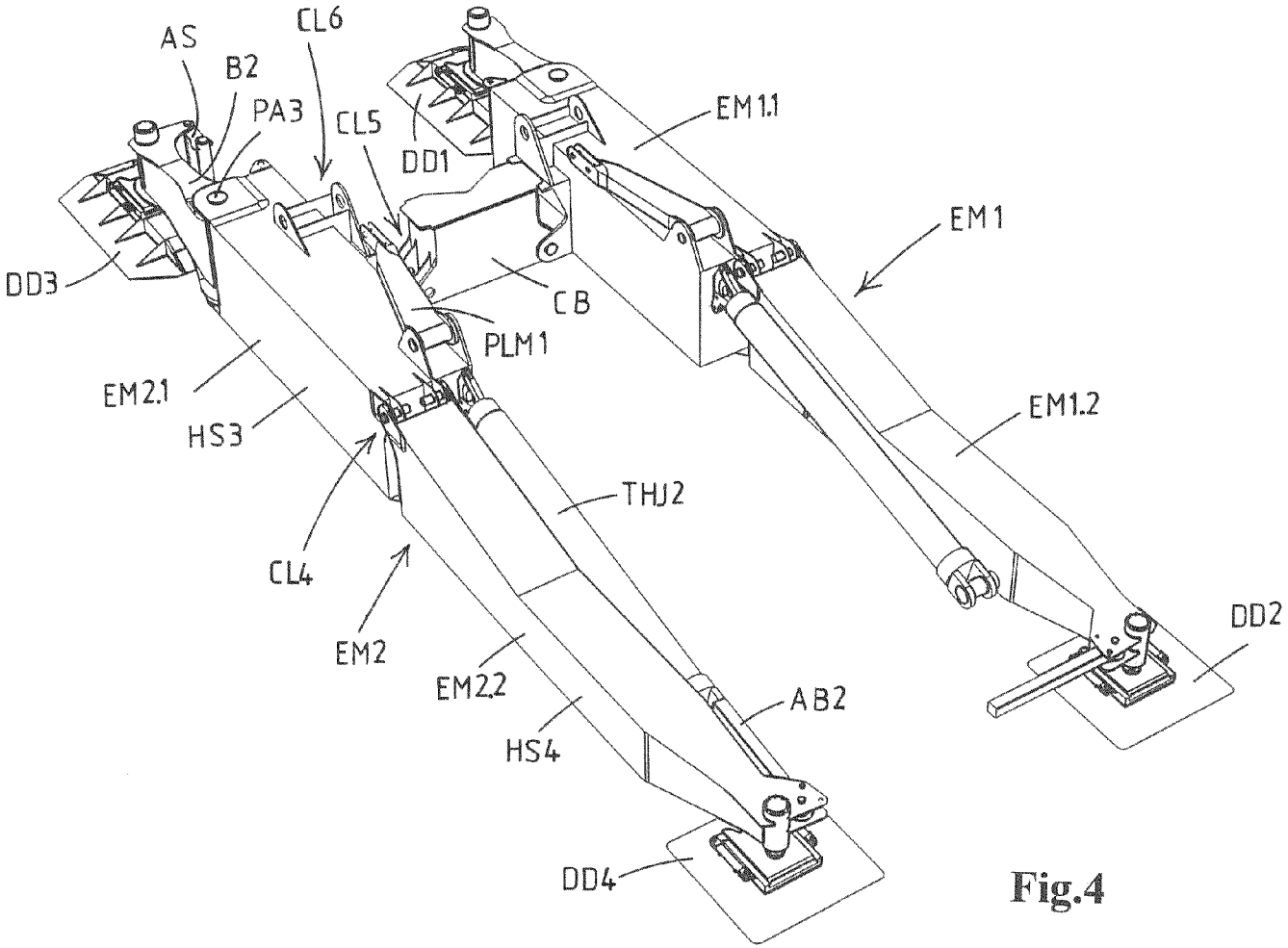

In FIG. 4, the second elongated member EM2 has been assembled in a similar way as the first elongated member EM1 has been assembled in FIGS. 1 and 2. A first part EM2.1 of the second elongated member EM2 has been provided comprising a hollow structure HS3 to which a displacement device DD3 is connected via support beam B2. The first part EM2.1 of the second elongated member EM2 further comprises a coupling location CL4 to which a second part EM2.2 of the second elongated member EM2 is connected, a coupling location CL5 to connect the second elongated member EM2 to the cross beam CB, and a coupling location CL6 for connecting the pedestal P which will be described at a later stage.

The beam B2 is pivotably connected to the structure HS3 about pivot axis PA3, so that the beam B2, and thereby the displacement device DD3, is moveable between a transport position and an operational position as shown in FIG. 4, similar to beam B1 of the first elongated member EM1.

The first part EM2.1 of the second elongated member EM2 also comprises a first part PLM1 of a passive locking mechanism, the function of which will be described later.

The second part EM2.2 of the second elongated member EM2 comprises a hollow structure HS4 to which a displacement device DD4, a telescopic hydraulic jack THJ2, and an aligning beam AB2 are connected. These elements are provided for the same functions as their counterparts on the first elongated member EM1.

It is important to notice that in FIG. 4, the second elongated member is supported from the surface by the displacement devices DD3, DD4, but not yet connected to the cross beam CB and thus not yet connected to the first elongated member EM1.

As can be clearly seen in FIG. 4, the two elongated members EM1 and EM2 are supported by respective displacement devices such that they can be displaced by said respective displacement devices independently from each other when the first and second elongated members are not connected to each other by the cross beam. This has the advantage that no separate lifting or handling device such as a heavy lifting crane is required for assembling the first and second elongated members to form the base structure. Until FIG. 4, assembling was carried out by handling and manipulating individual components. However, by connecting individual components together, elongated members have been created having a size and weight that in many embodiments can no longer be easily handled and manipulated using the transport vehicles and/or the forklift truck. The advantage of the modular drilling rig system according to the invention is that this is also not necessary as the elongated members can already be moved by the displacement system before the elongated members are connected to each other.

Preferably, as in this embodiment, the displacement devices DD1-DD4 are configured such that the displacement foot of each displacement device is at least partially rotatable about its longitudinal axis to adapt the substantially horizontal direction to a desired direction of movement. It may be constructionally advantageous that the upper part and lower part can only move with respect to each other in a single horizontal direction. By rotation of at least part of the displacement foot this horizontal direction of movement may be adjusted to the desired direction of movement.

Preferably, as in this embodiment, the displacement foot is rotatable between two rotational positions at about 90 degrees with respect to each other. By making displacement steps in one or both of the two resulting perpendicular horizontal directions, an elongated member and later the drilling rig can be moved to any desired location.

In FIG. 4, the displacement feet of displacement devices DD3 and DD4 are in a rotational position such that the second elongated member can be moved in a horizontal direction parallel to a longitudinal axis of the second elongated member.

Figure 5:
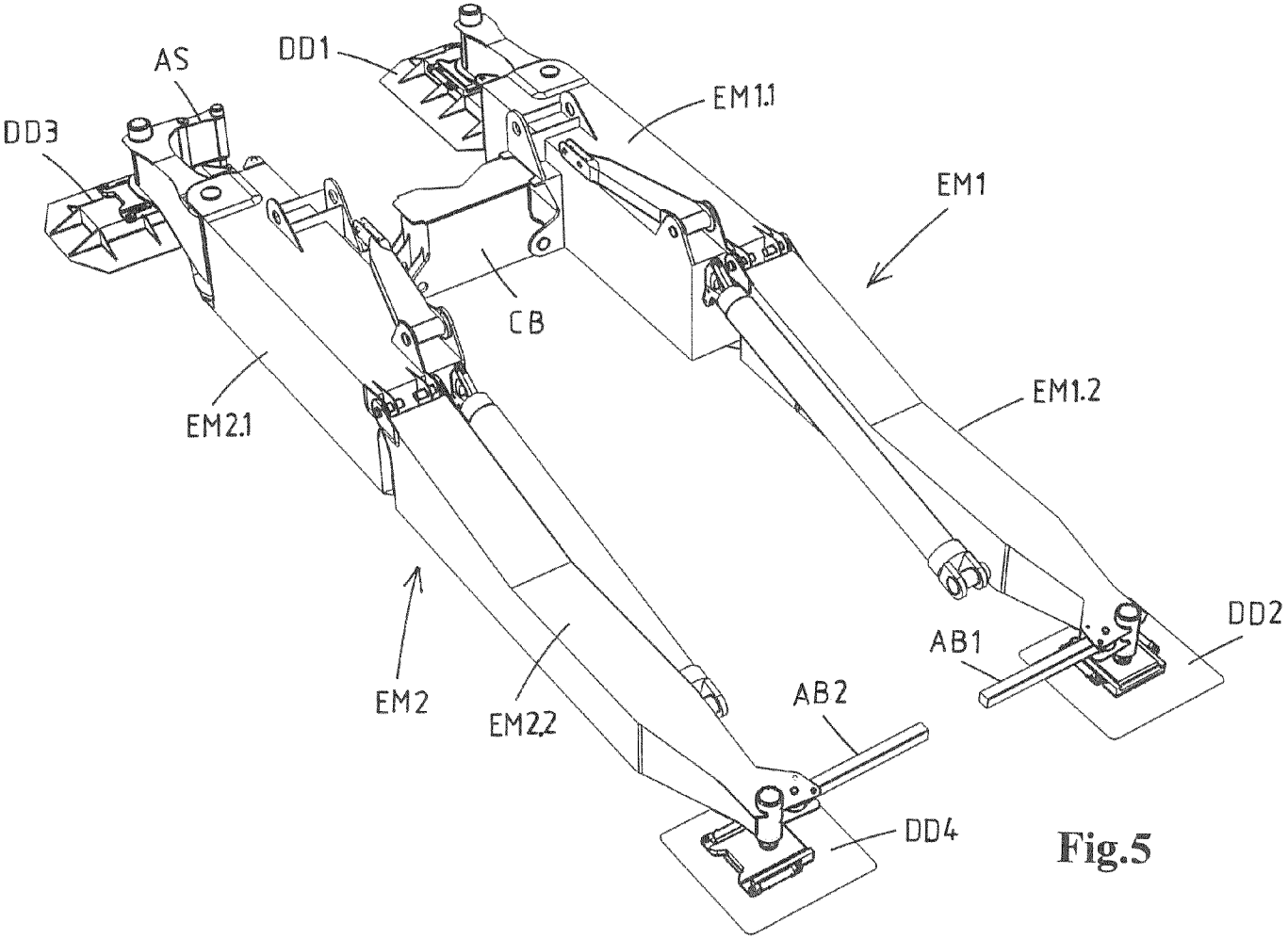

In order to move the second elongated member EM2 in the direction of the first elongated member EM1 to connect the two elongated members together by the cross beam CB, the displacement feet of displacement devices DD3 and DD4 are rotated 90 degrees as shown in FIG. 5.

FIG. 5 further shows that alignment beam AB2 is pivoted to an aligning position to engage with alignment beam AB1 which is also in the aligning position. Engagement between the alignment beams AB1, AB2 ensures a proper alignment and distance between the first and second elongated members EM1, EM2, see FIG. 6.

FIG. 5 also shows that an additional support AS which is connected to support beam B2 is positioned such that the angular orientation of the second elongated member EM2 about a rotation axis parallel to the longitudinal axis of the second elongated member EM2 relative to the displacement device DD3 is fixed, thereby preventing the second elongated member EM2 to rotate about the rotation axis during connecting of the first and second elongated members EM1, EM2.

Rotation of the first and/or second elongated members relative to their respective displacement devices may be possible due to bearings, e.g. spherical bearings, being present between the first and/or second elongated members and the respective displacement devices. During connecting of the first and second elongated members it is therefor preferred that undesired rotation is prevented. The additional support AS as shown in FIG. 5 is one way of preventing undesired rotation. It will be clear to the skilled person that may other ways of preventing rotation can be thought of, for instance temporarily bolting components together, all of them falling within the scope of the invention.

The additional support AS is configured such that in the position of FIG. 5 it is able to prevent rotation of the second elongated member relative to the displacement device DD3, and such that in the position of e.g. FIG. 4, the second elongated member is free to rotate relative to the displacement device DD3.

Figure 6:
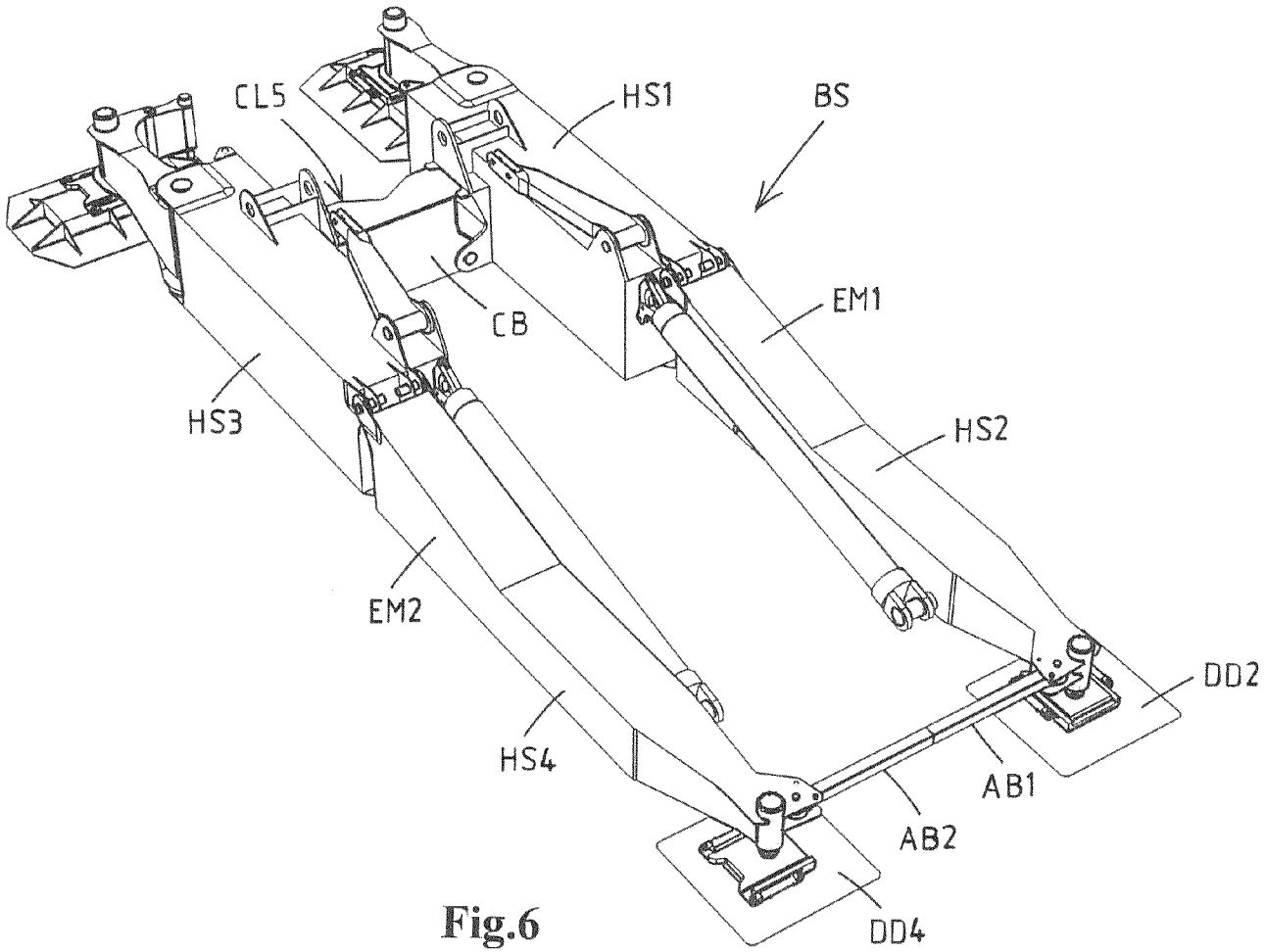

Due to the rotational position of the displacement feet of displacement devices DD3, DD4 in FIG. 5, the second elongated member EM2 can be moved in the direction of the first elongated member EM1. The second elongated member EM2 will be moved towards the first elongated member EM1 until the aligning beams AB1 and AB2 engage with each other and an axial end of the cross beam CB can be connected to a side of the second elongated member EM2 at coupling location CL5. This is shown in FIG. 6. It will be clear to the skilled person that in an alternative embodiment, the first elongated member EM1 including cross beam CB may move towards the second elongated member EM2 for connection purposes.

After connecting the second elongated member EM2 to the first elongated member by the cross beam, the first and second elongated member together with the cross beam form the rigid base structure BS. The first and second elongated members and the cross beam together form a H-arrangement when seen from above, with the legs of the H at the side remote from the well centre being larger than the legs of the H at the side of the well centre. The legs of the H at the side of the well centre are mostly formed by the beams B1 and B2, so that the structures HS1-HS4 together with the cross beam form a C-arrangement when seen from above, with the legs of the C at the side remote from the well centre, such that the first and second elongated members extend side-by-side with a spacing there between dimensioned to receive a vehicle carrying at least a foot portion of the drilling rig mast DRM in a substantially horizontal connecting portion, such that a foot of the drilling rig mast is arranged between the first and second elongated members and connectable to the pedestal P in its substantially horizontal connecting position; and after the unit formed by the connected pedestal and drilling rig mast has pivoted to a substantially vertical operational position, to receive a pipe loader.

The configuration of the base structure forming a C-arrangement, i.e. a H-arrangement when the support beams B1 and B2 are also taken into account, when seen from above is advantageous as the well centre is freely accessible, e.g. to position a BOP (Blow Out Preventer). Another advantage is that the drilling rig system may be allowed to move away from the well centre, e.g. to move to another well centre nearby.

The formed base structure is supported from the surface by the displacement devices of the displacement system. The displacement system is configured to displace the two elongated members of the base structure together in order to displace the drilling rig in the operational mode. When the displacement feet of the displacement devices are in the extended position, the drilling rig can be displaced by relative movement in the horizontal direction of the upper parts with respect to the lower parts. This movement can be relatively small. In the retracted position, the displacement feet are no longer arranged on the support surface and the lower parts and the upper parts can be brought back in their initial relative position without movement of the drilling rig with respect to the support surface. By repeating these horizontal relative movements of the upper parts and lower parts in the extended and retracted position of the displacement feet, the drilling rig can be moved step-wise over the support surface.

An advantage of using the displacement system to move the drilling rig from and to the well centre is the increased safety as the assembly and installation of the drilling rig system can be performed remote from the sensitive well centre and subsequently the drilling rig can be moved towards the well centre.

After forming the base structure BS, the alignment beams AB1, AB2 can be moved back to a storage or inoperable position, and the additional support AS can also be moved back to a position in which rotation of the second elongated member EM2 relative to displacement device DD3 is no longer blocked as shown in FIG. 7.

Figure 8:
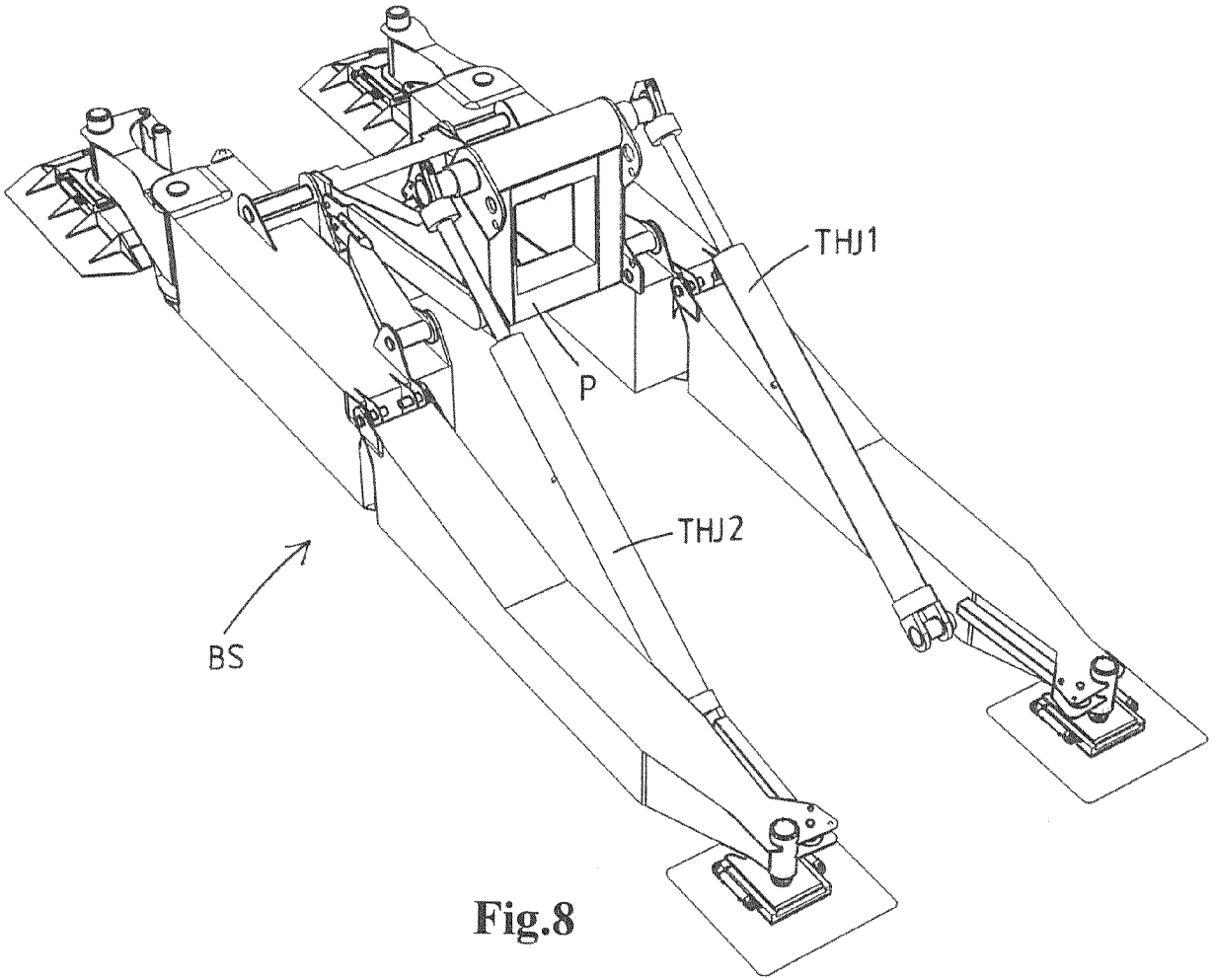

FIG. 7 also shows the providing of the pedestal P which is adapted to—in a substantially vertical operational position—support the drilling rig mast DRM above the well centre. In order to allow the drilling rig system according to the invention to be transfigurable between a transport mode and an operational mode, the pedestal P is operable to pivot between a substantially horizontal connecting position as shown in FIG. 8 and the substantially vertical operational position as shown e.g. in FIG. 20. The pedestal is adapted to be—in a substantially horizontal connecting position thereof—pivotally connected about a pedestal pivot axis PPA to said base structure BS at coupling locations CL3 and CL6 provided respectively on structures HS1 and HS3 of the base structure. It is also conceivable that the pedestal is connected to another component of the base structure. Preferably, the pedestal pivot axis is provided at a fixed stationary position on the base structure. This position is preferably an elevated position.

Preferably, as in this embodiment, the pedestal P is connected to the base structure BS at a lower end thereof, wherein 'lower' is defined as the lower portion of the pedestal, when it is in a substantially vertical operational position. In the substantially horizontal connecting position the pedestal P is also adapted to be connected to a foot of the drilling rig mast DRM, preferably at an upper end thereof, wherein 'upper' is defined as the upper portion of the pedestal when it is in a substantially vertical operational position. In an embodiment, the foot of the drilling rig mast comprises a mast connection point or member to be connected pivotally to the pedestal pivot axis PPA on the base structure.

To provide the pedestal, a vehicle carrying the pedestal only has to enter the spacing in between the first and second elongated members at the side remote from the well centre and position the pedestal for connection to the base structure.

In FIG. 7 it can also be seen that the displacement feet of the displacement devices DD3, DD4 have rotated 90 degrees again, so that all displacement devices are able to move the base structure in the same substantially horizontal direction and do not interfere with each other.

The vehicle carrying the pedestal P for connecting the pedestal to the base structure preferably maintains carrying the pedestal P until the telescopic hydraulic jacks THJ1, THJ2 engage with the pedestal P as shown in FIG. 8 and have lifted the pedestal P from the vehicle.

The telescopic hydraulic jacks THJ1, THJ2 are part of a drive assembly configured to raise and lower the connected pedestal P and drilling rig mast DRM. Although it is possible for the drive assembly to engage on the drilling rig mast in an embodiment, it is preferred that the drive assembly engages on the pedestal P as shown in this embodiment and not on the drilling rig mast, as the pedestal is usually of a much more robust configuration.

In order to control the telescopic hydraulic jacks THJ1, THJ2, the drilling rig system may be provided with a hydraulic power unit including a pump and a reservoir for hydraulic fluid, preferably the pump having an electric motor and the drilling rig system being provided with a fuel powered generator providing electricity for the pump motor and possibly electrical control of the hydraulic system, which hydraulic power unit or components thereof may be integrated into the base structure, e.g. into the second parts EM1.2, EM2.2 of respectively the first and second elongated members EM1, EM2. A control for the hydraulic system can e.g. be embodied for remote control, e.g. an operator carrying a control box is known in the field of cranes.

An important component of the modular drilling rig system is the drilling rig mast DRM having a top end and a foot. In an operational position the mast is positioned vertically above the well centre to perform drilling activities. According to this embodiment, the drilling rig mast DRM is moveable between a substantially horizontal connecting position and the operational position. The drilling rig mast is composed of multiple transportable mast sections, usually 2-4 sections, in this embodiment three sections, at least including a foot or lower section forming the foot of the drilling rig mast and a top section forming the top of the drilling rig mast. The mast sections need to be assembled end-to-end, and are connected to form a drilling rig mast having a top end and a foot.

Figure 9:
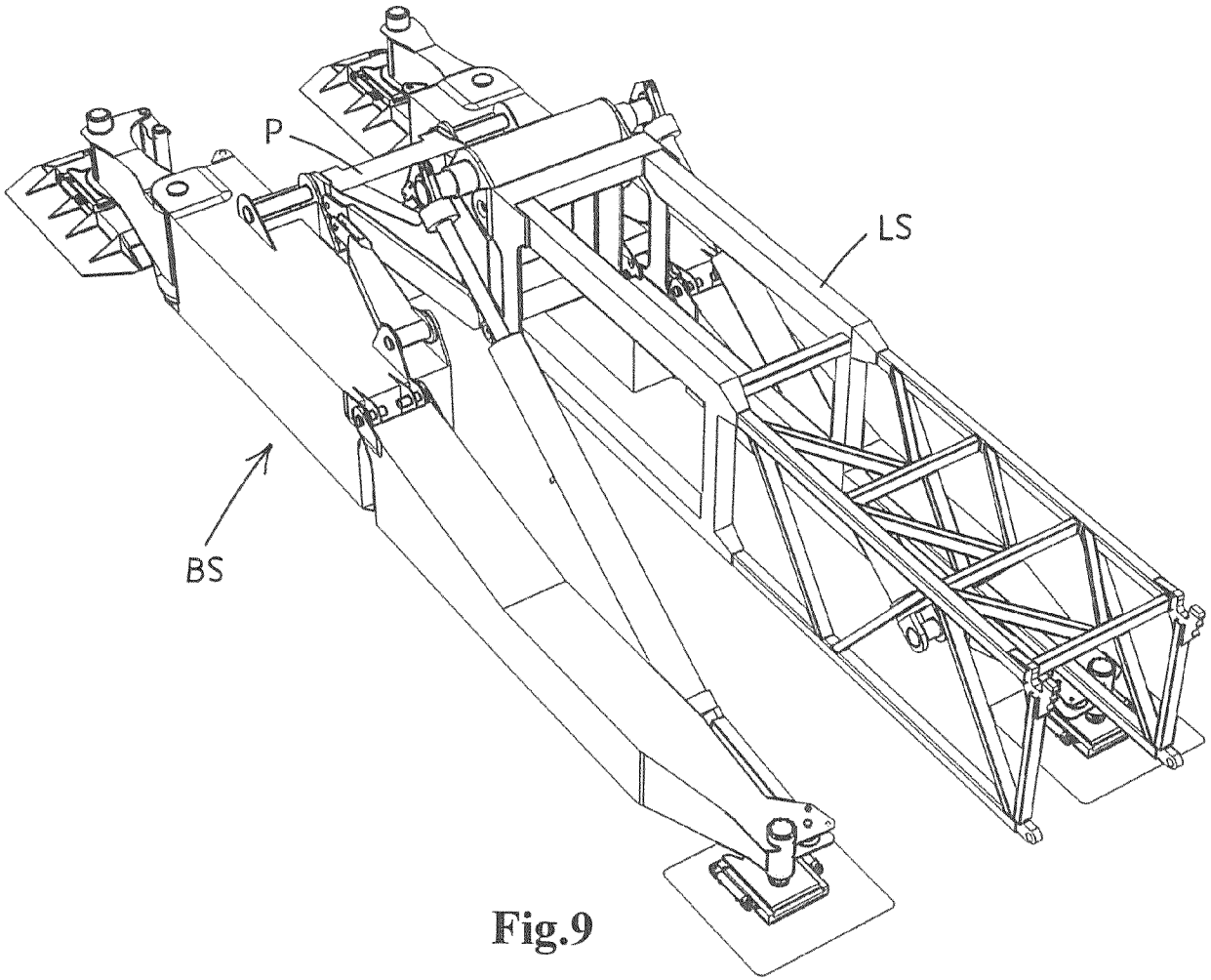

FIG. 9 depicts the assembly of a lower section LS to the pedestal P. The lower mast section LS is supplied, e.g. by a trailer of a road vehicle, and connected to the pedestal. The drive assembly, i.e. the telescopic hydraulic jacks THJ1, THJ2 may then be operated to raise the lower mast section from the trailer.

Figure 10:
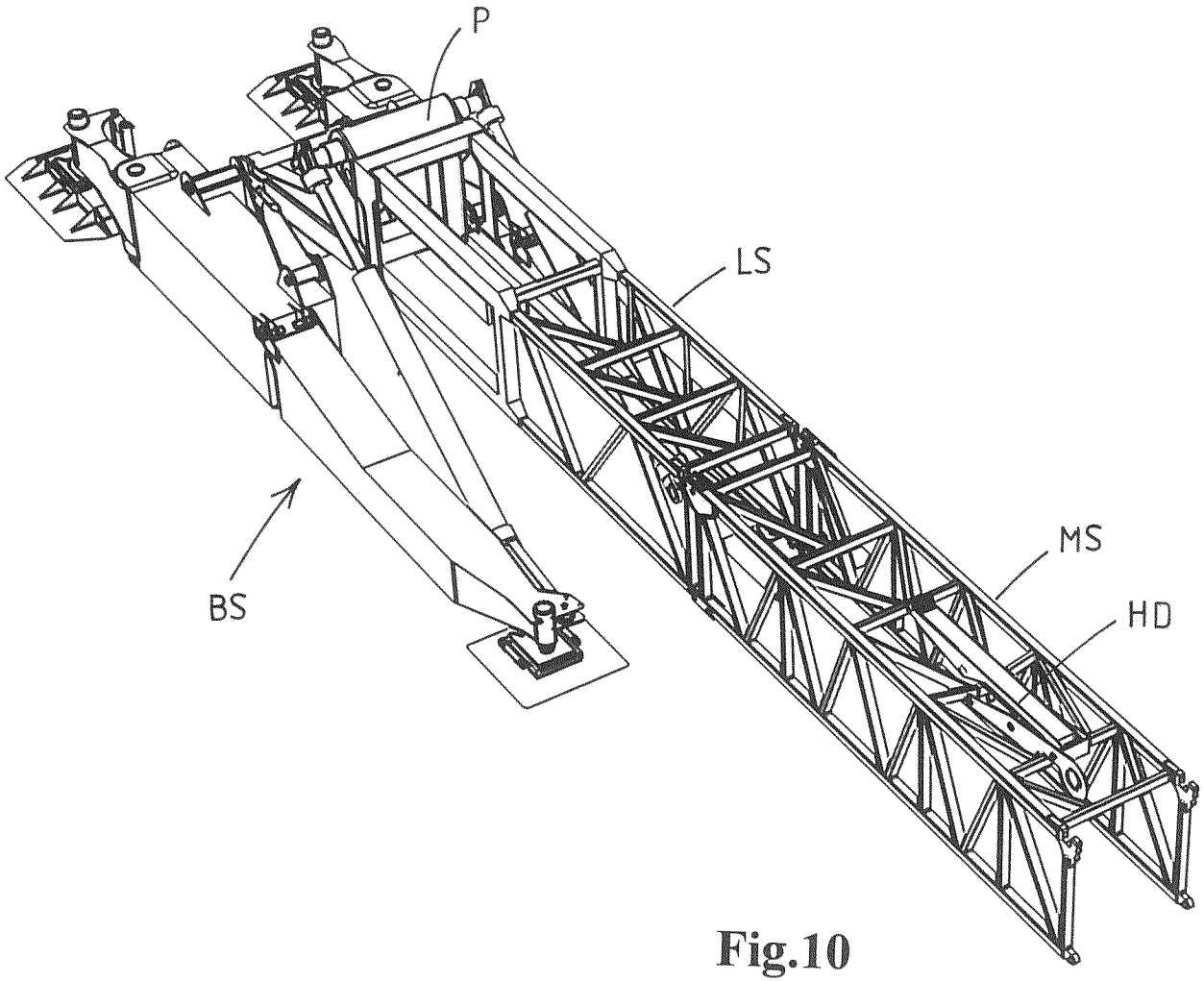

FIG. 10 depicts the assembly of a middle section MS to the lower mast section LS. The assembly may have been performed as follows. The middle section MS may be provided on a trailer of a vehicle in lying condition. In order to align the upper end of the lower section LS with the lower end of the middle section MS the lower section LS may have been tilted downwards to obtain alignment. Then the connection is established only at the adjoining top facing corners or sides of these lower and middle mast sections LS, MS, this connection forming a temporary hinge. The lower mast section LS has hooks at the top facing corners, while the middle mast section MS having mating members to establish a hinged connection. Then the lower mast section is raised again by operating the drive assembly to obtain full alignment of the lower and middle mast sections, so that their lower corners also meet and the lower and middle mast sections are then raised somewhat further so that the mast clears the trailer which is then drive away.

Figure 11:
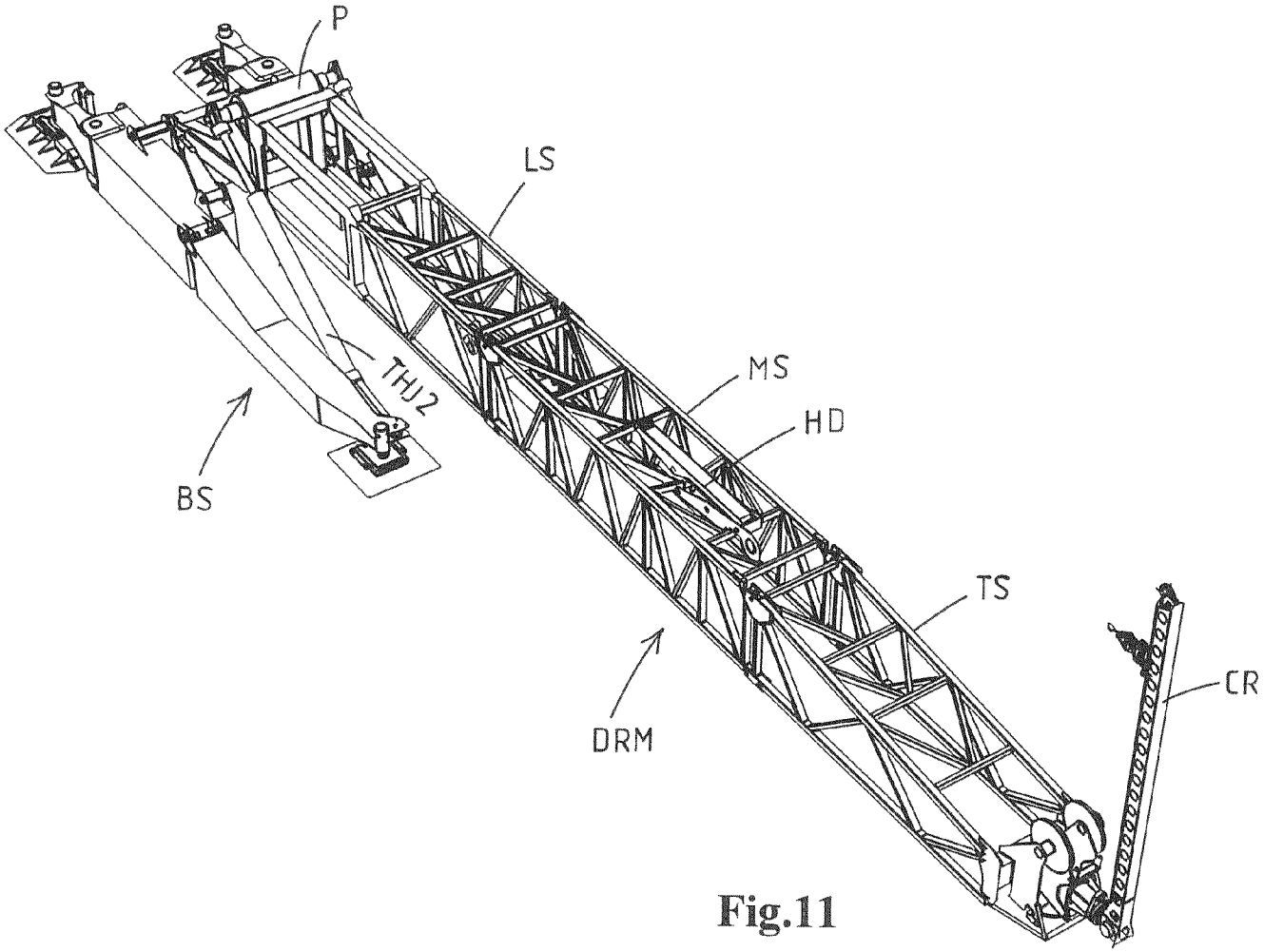

In a similar way, a top mast section TS can be connected to the middle mast section MS as shown in FIG. 11. The top mast section TS may also be supplied by a vehicle. By connecting the top mast section to the middle mast section in the same way as the connection between the middle mast section and the lower mast section, the completed mast can be raised to clear from the trailer which then departs.

Possibly, drilling equipment such as sheaves, crown blocks etc. are integrated into one or more of the mast sections for transportation as integrated items. In this embodiment, the middle mast section for instance comprises a hoist device HD and the top mast section includes a crane CR, which may be transported in an orientation parallel to the top mast section, but in FIG. 11 already has been moved to an operational position perpendicular to a longitudinal axis of the top mast section.

Figure 12:
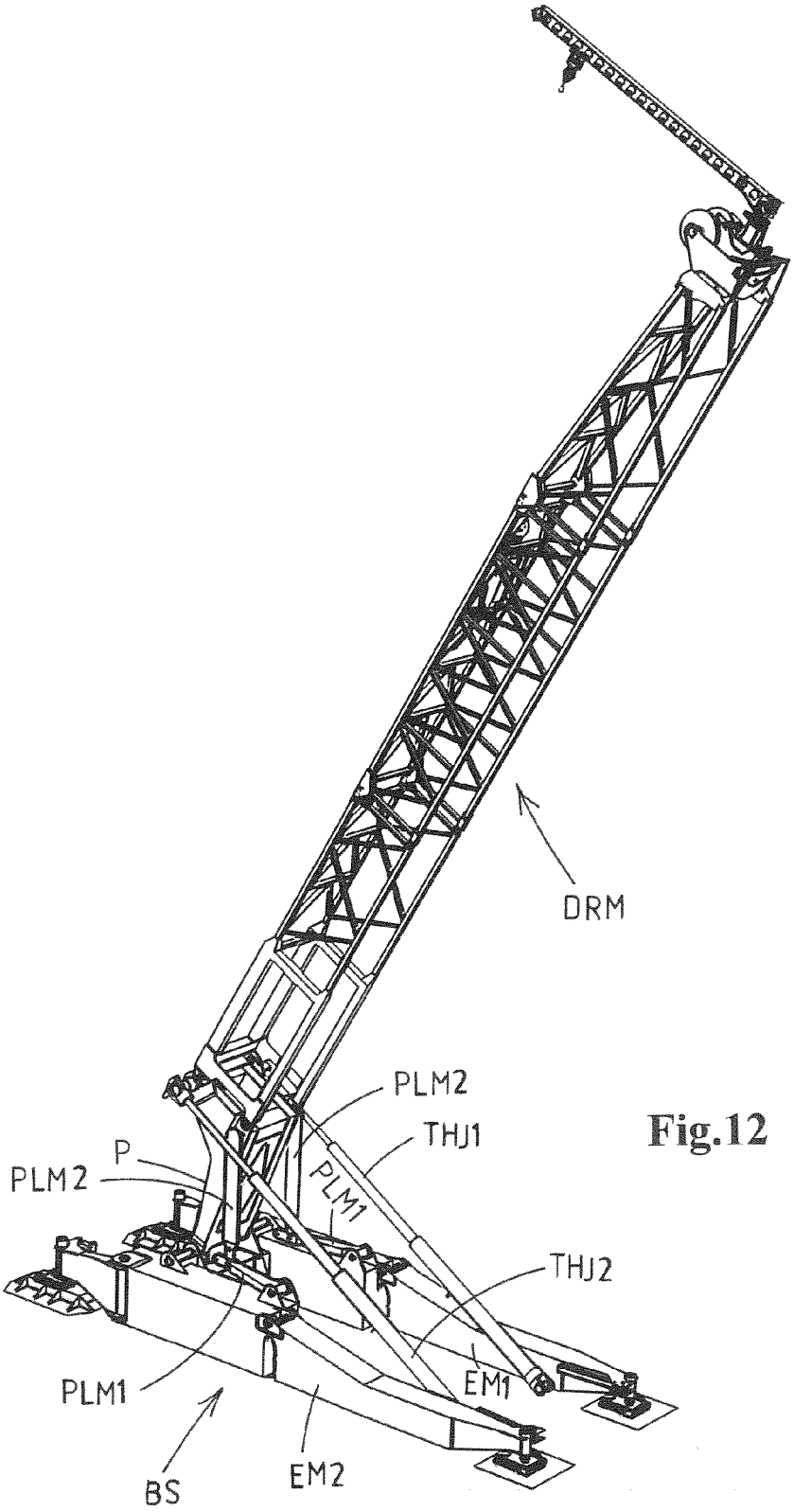
Figure 13:
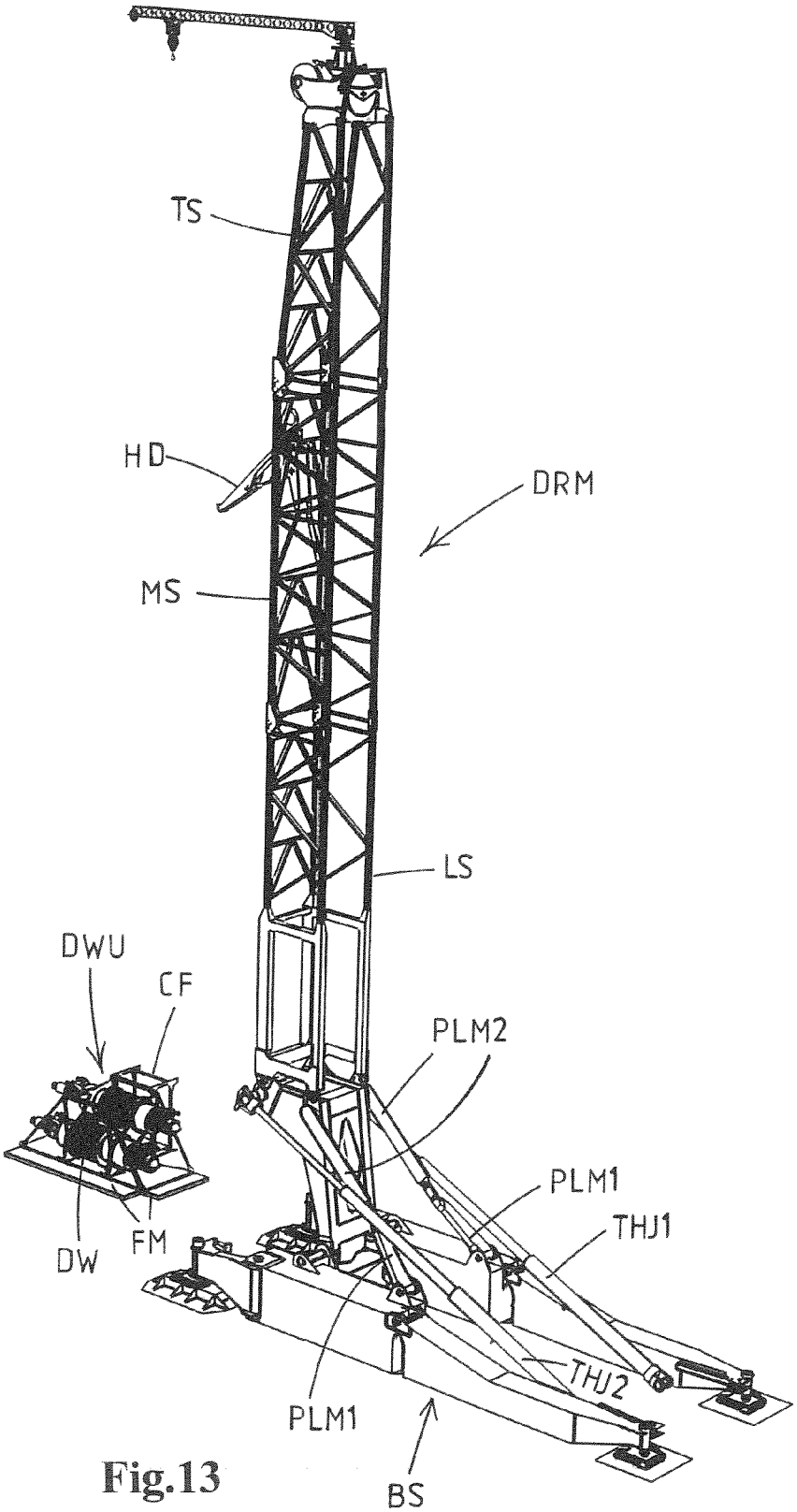

The drive assembly, i.e. the hydraulic jacks THJ1, THJ2, is adapted to pivot the connected pedestal P and drilling rig mast DRM composed from said mast section as a unit between the substantially horizontal connecting position as shown in FIG. 11 and the vertical operational position as shown in e.g. FIG. 13. Before reaching the vertical operational position, said unit is stopped at an intermediate position as shown in FIG. 12 to connect the first parts PLM1 of the passive locking mechanism at both the first and second elongated members EM1, EM2 to respective second parts PLM2 of the passive locking mechanism which are pivotally connected to the pedestal P. Each first part PLM1 of the passive locking mechanism is pivotally connected to a respective second part PLM2 of the passive locking mechanism, so that the drive assembly is still able to pivot the drilling rig mast and pedestal. When the drilling rig mast is positioned in the substantially vertical operational position as shown in FIG. 13, the first and second parts PLM1, PLM2 are aligned with respect to each other and an additional connection can be made between the first and second parts PLM1, PLM2, thereby locking the angular position of the drilling rig mast relative to the base structure BS.

In FIG. 13 the drilling rig mast DRM is positioned in the substantially vertical operational position. FIG. 13 also shows the supply of a drilling drawworks unit DWU with drilling drawworks DW on a vehicle (not shown). The drilling drawworks unit further comprises a connecting frame CF to connect the drilling drawworks unit to the drilling rig mast and floor members FM to allow personnel access to the drilling drawworks for maintenance and repair.

Figure 14:
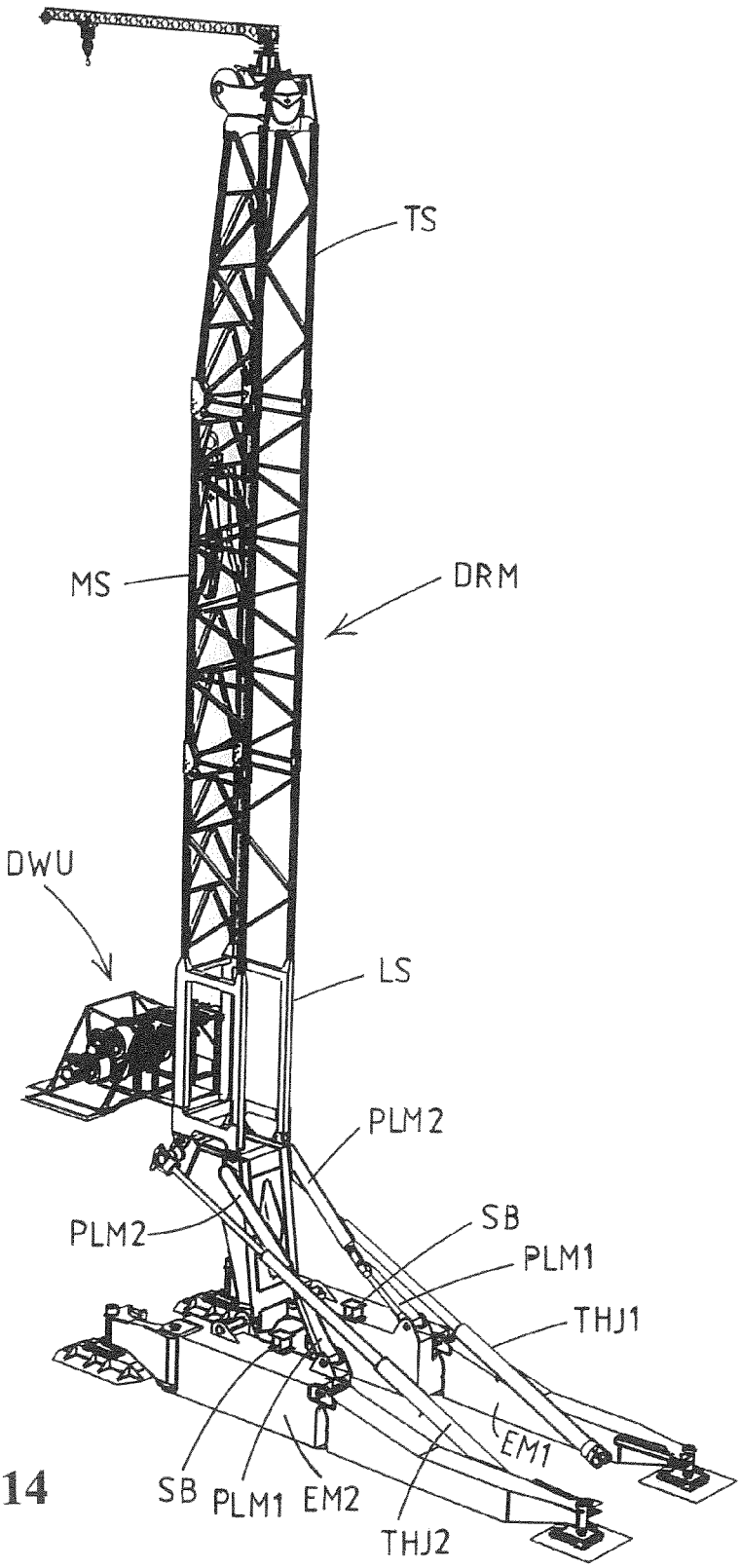

The hoist device HD at the middle mast section MS of the drilling rig mast DRM is used to hoist the drilling drawworks unit DWU to an elevated position for connection to drawworks connection members of the lower mast section LS as shown in FIG. 14, so that the drilling drawworks are connected to the drilling rig mast at an elevated position. Alternatively, the drilling drawworks unit may be connected to the pedestal.

In this embodiment, the drawworks position will be at the same level as the drill floor which is assembled at a later stage. In another embodiment, the drawworks position is spaced above the drill floor. As such, the drilling drawworks are no longer positioned on the ground in the drilling area, but are connected to the drilling rig mast or the pedestal in an elevated drawworks position. The thus achieved clearance of the ground in the drilling area is very advantageous during drilling operations and enables a more efficient drilling process.

In FIG. 14, the base structure is provided with a support block SB on the first elongated member EM1 and a support block SB on the second elongated member EM2. The first and second parts PLM1, PLM2 of the passive locking mechanism are not yet connected to each other in order to lock the angular orientation of the drilling rig mast relative to the base structure.

Figure 15:
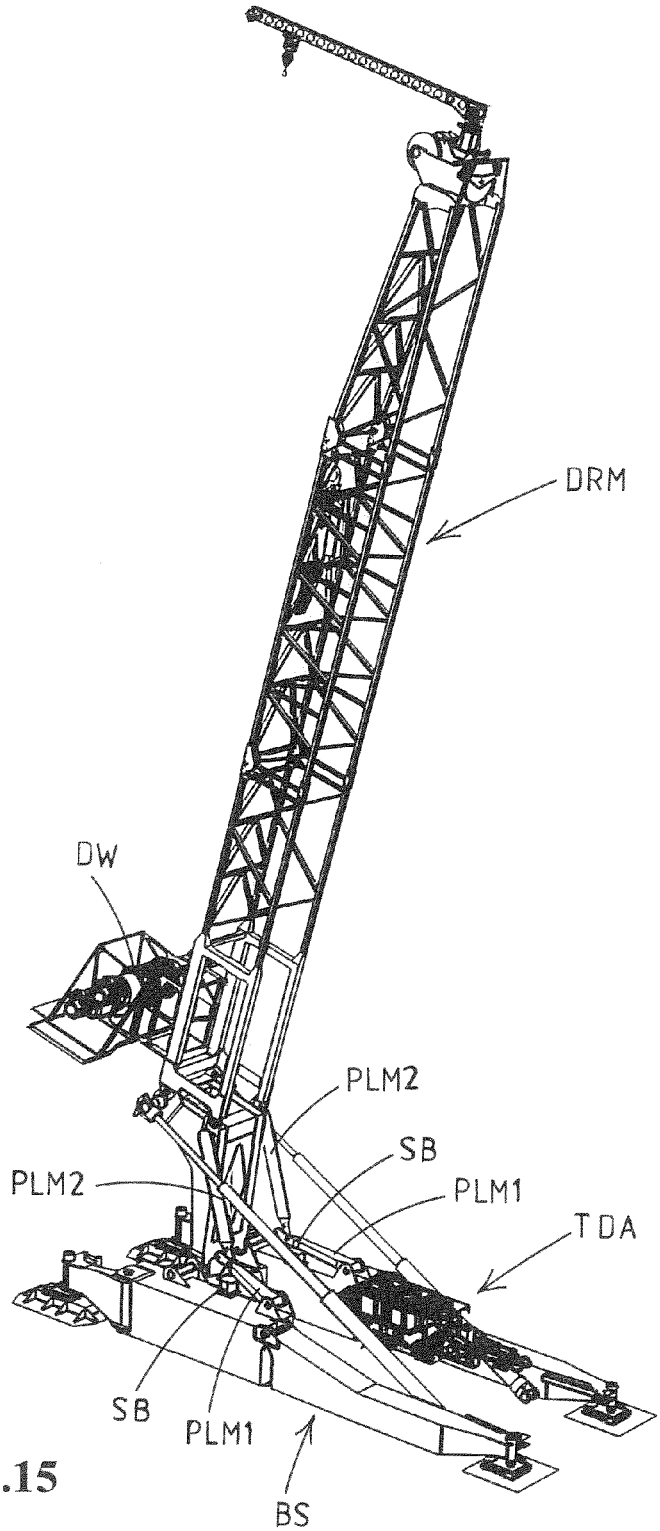

In order to provide the drilling rig mast with a top drive assembly TDA including a top drive, the drilling rig mast is tilted backwards by the drive assembly as shown in FIG. 15. In order to support the drilling rig mast in this position, use is made of the support blocks SB on either side of the base structure BS, which support blocks are configured to support the first PLM1 or second PLM2 parts of the passive locking mechanism near the connection between the first and second part, such that the drilling rig mast can be supported in the oblique orientation relative to the base structure as shown in FIG. 15.

The top drive assembly TDA is provided by a vehicle, not shown, and is lifted using the drawworks DW. A hoist block (not shown) is lowered by the drawworks from a top end of the drilling rig mast until a coupling can be made between the hoist block and the top drive assembly for lifting of the top drive assembly.

Figure 16:
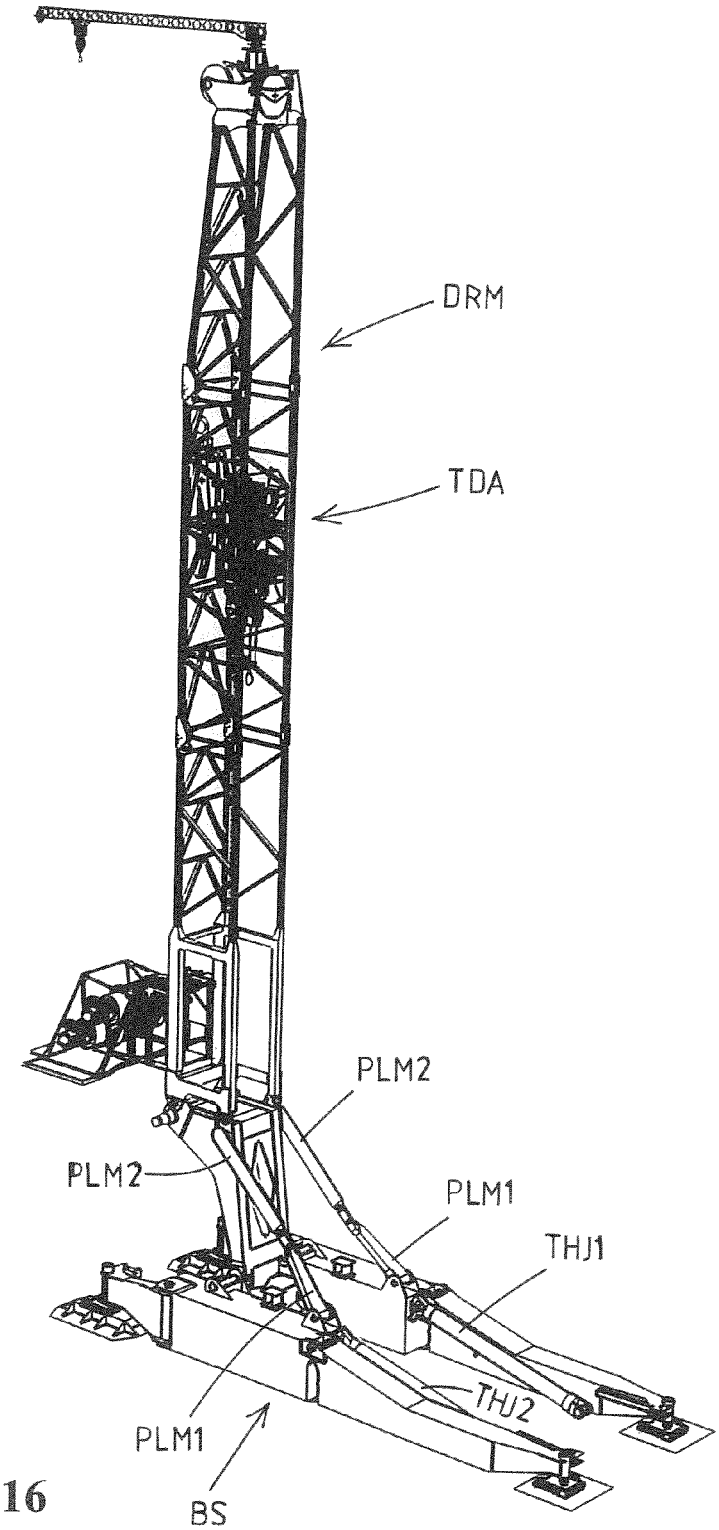

By lifting the top drive assembly TDA and subsequently tilting the drilling rig mast DRM back to the substantially vertical operational position as shown in FIG. 16, the top drive assembly is received in the drilling rig mast. Connecting the top drive assembly to the drilling rig mast will subsequently allow the top drive to be moved along the drilling rig mast for drilling operations.

FIG. 16 further shows that after tilting the drilling rig mast to the substantially vertical operational position, the respective first and second parts of the passive locking mechanism are connected to each other to lock the orientation of the drilling rig mast with respect to the base structure, so that the drive assembly can be disconnected from the pedestal, i.e. the telescopic hydraulic jacks THJ1 and THJ2 are positioned in the transport position which was also described in relationship to FIGS. 2 and 4.

Figure 17:
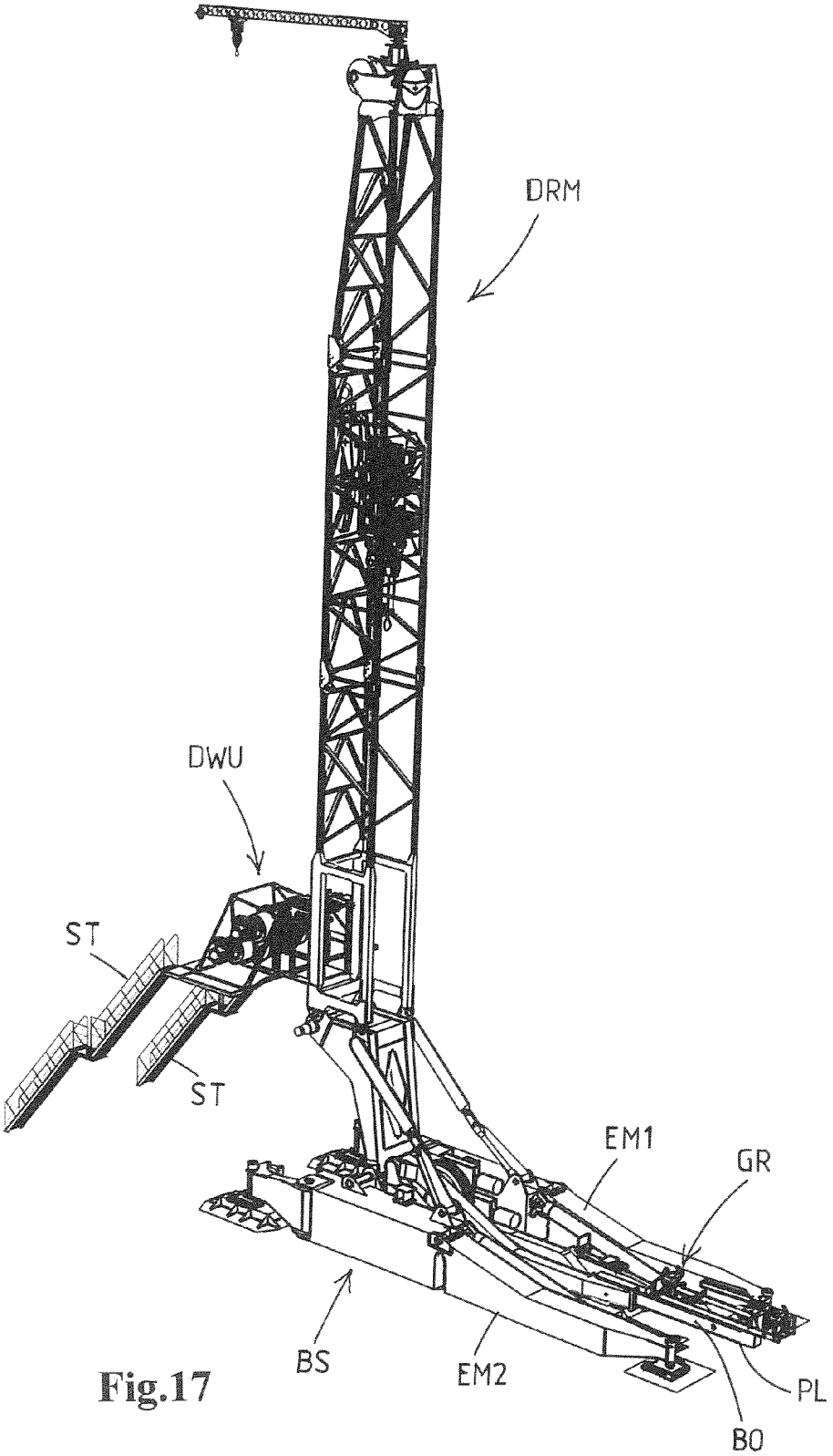

In FIG. 17 it is shown that the drilling drawworks unit DWU is provided with stairs ST to allow access to the floor members of the drawworks unit from the surface.

In between the two elongated members of the base structure a pipe loader PL is provided, preferably a compact pipe loader as described in unpublished patent application NL2010378 of the same applicant, which is incorporated herein by reference. The compact pipe loader may be a system for handling tubulars, comprising an apparatus for moving a tubular between a substantially horizontal position and an upward angled position, e.g. substantially vertical position, wherein said apparatus comprises a base, a boom BO pivotally connected to the base about a horizontal boom pivot axis between a substantially horizontal position and an upward angled position, a boom pivot drive mounted on said base and adapted to pivot the boom, and a tubular gripper GR attached to the boom and adapted for gripping the tubular. The boom pivot drive comprises a central gear wheel that is rotatable mounted on the base about a central gear wheel axis parallel to the horizontal boom pivot axis, which central gear wheel is connected directly or via a transmission to the boom. The boom pivot drive further comprises one or more drive gear members that are each rotatable mounted on the base and each rotatable about a corresponding drive gear member axis, meshing with the central gear wheel. The boom pivot drive also comprises one or more motors connected to said one or more drive gear members and allowing to drive said one or more drive gear members so as to pivot the boom between said substantially horizontal position and said upward angled position.

Alternatively, the pipe loader may be a system for handling tubulars, comprising an apparatus for moving a tubular between a substantially horizontal position and an upward angled position, e.g. substantially vertical position, wherein said apparatus comprises a base, a boom pivotally connected to the base about a horizontal boom pivot axis between a substantially horizontal position and an upward angled position, a boom pivot drive mounted on said base and adapted to pivot the boom, and a tubular gripper attached to the boom and adapted for gripping the tubular. The boom pivot drive comprises a crank member that is rotatably mounted to the base about an crank member axis parallel to the boom pivot axis, which crank member has a crank end remote from said crank member axis. The boom pivot drive further comprises a connecting rod, which is pivotally attached to the crank end via a first pivot axis, and pivotally attached to the boom via a second pivot axis remote from the boom pivot axis, wherein the horizontal boom pivot axis, and the first and second pivot axes of the connecting rod are parallel to each other. The boom pivot drive also comprises one or more motors that drive said crank member so as to pivot the boom between said substantially horizontal position and said upward angled position In FIG. 17, the boom BO is shown in the substantially horizontal position. The drilling rig mast has as is preferred a c-shaped cross-section with three latticed sides having vertical longitudinal columns at their corners and a lattice framework there between. The drilling rig mast has one open side, said open side facing downwards when the mast is held in a generally horizontal position relative to the base structure. The open side provides an opening to allow for the top drive and drilling tubulars to be brought into the space within the contour of the drilling rig mast. The drilling tubulars can be brought into the space and can be removed from the space using the pipe loader PL. drilling tubulars include drill pipes and/or risers and/or casings. Preferably, the pipe loader can be transported in a single container.

Figure 18:
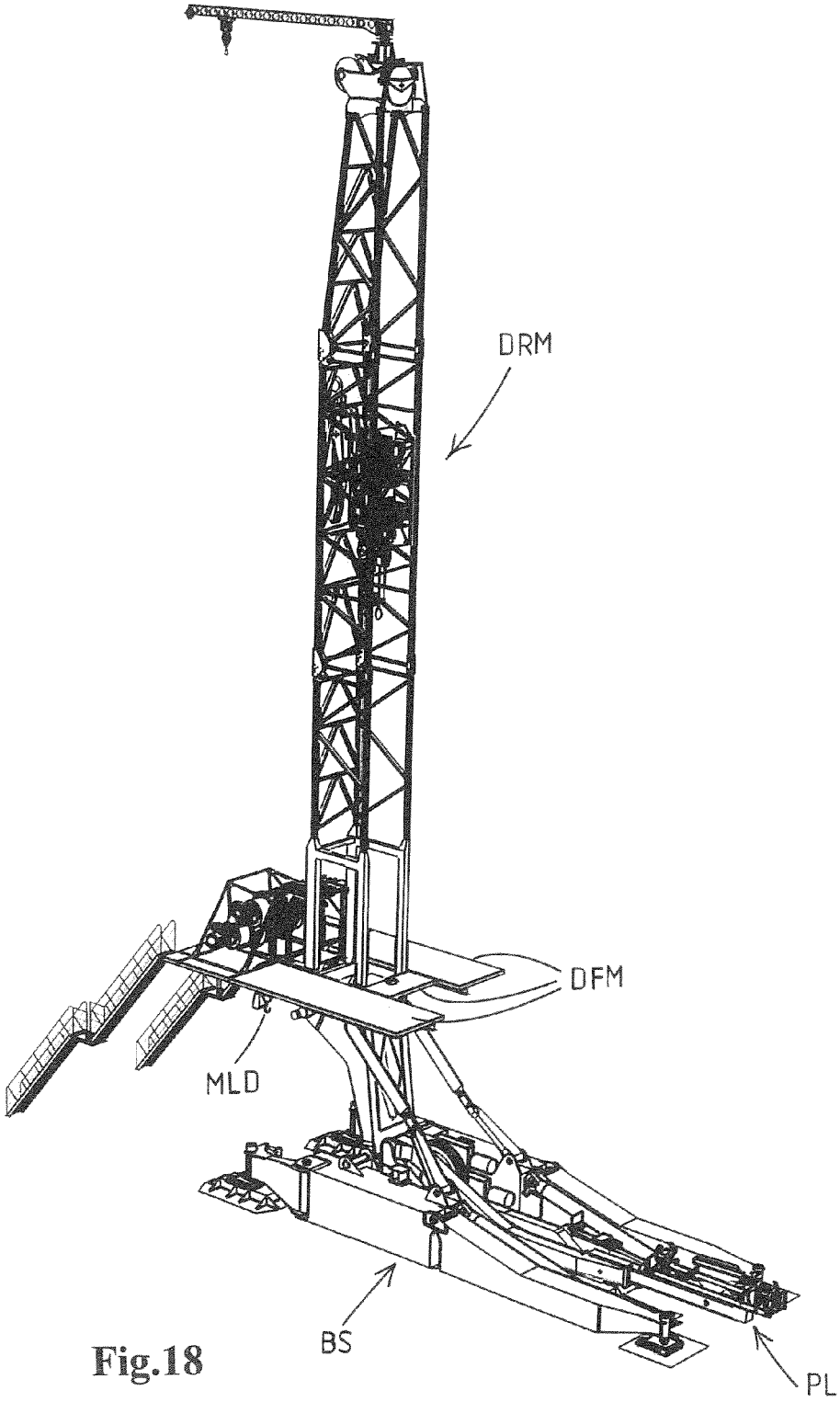

In FIG. 18, the drilling rig is further assembled by adding drill floor members DFM adapted to form a drill floor in the operational mode, said drill floor in the operational model being located at an elevated position above said base structure. It is noted that a drill floor member may include the actual drill floor, e.g. including drill floor plates, but may also be formed by a drill floor frame member on top of or onto which floor plates or the like are to be mounted, e.g. at a later stage. For example, drill floor members that are to be present on opposite sides on the outside of the mast, above the elongated members of the base structure are hoisted onto the mast after it has been erected as in the embodiment shown in FIG. 18, or one or ore drill floor members form part of a mast section, e.g. as a hinged flaps that be deployed in the operational mode.

In this embodiment, the large drill floor members DFM at either side of the mast are provided with a moveable lifting device MLD. The lifting device comprise a relatively small winch, hoist block with hook and a carriage carrying the small winch and hoist block, which carriage can be moved along a guide below the drill floor members. The moveable lifting devices can be used to lift and position a BOP (Blow Out Preventer) into the firing line on the well centre side of the pedestal.

Figure 19:
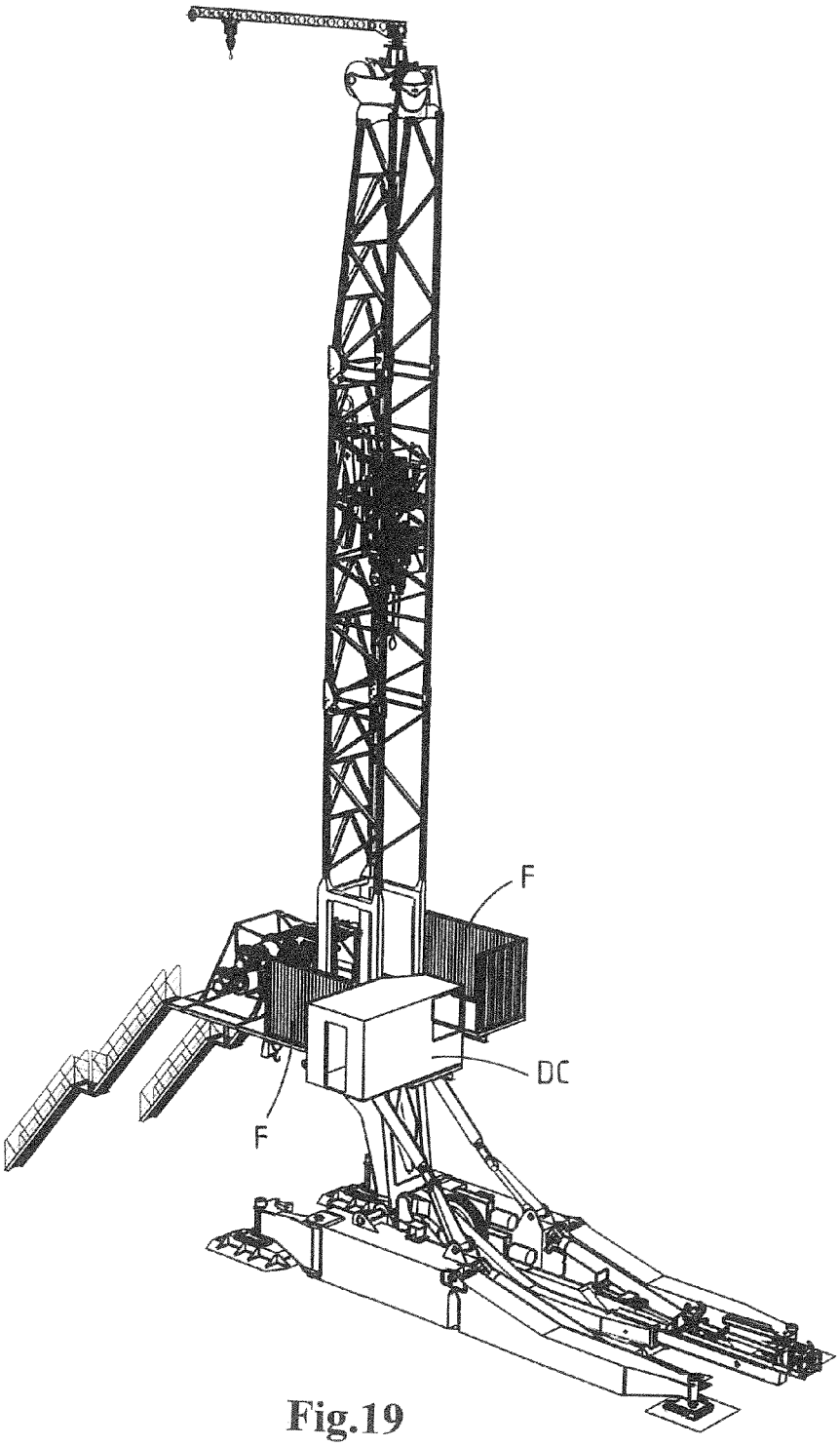

In FIG. 19 fencing F and a drillers cabin DC are provided on the drill floor for safety and control reasons.

FIG. 20 depicts the fully assembled and operational drilling rig. It may be possible that some drilling rig components such as additional drill floor members, drawworks, a blow-out preventer (BOP), pipe tubes, a pipe rack, mud pumps, shaker tanks, etc. have not been explicitly assembled, shown and/or described, but it will be clear to the skilled person that these may also form part of the drilling rig and may be assembled individually or as part of another component. In FIG. 20, an additional stair has been installed to allow easy access to the drillers cabin CB, and tubular supply components TSC have been installed to supply tubulars to the pipe loader PL.

FIGS. 21-25 depict a side view of a modular drilling rig system according to another embodiment of the invention and in particular show the steps of providing the top drive assembly in a drilling rig mast of the drilling rig.

Figure 21:
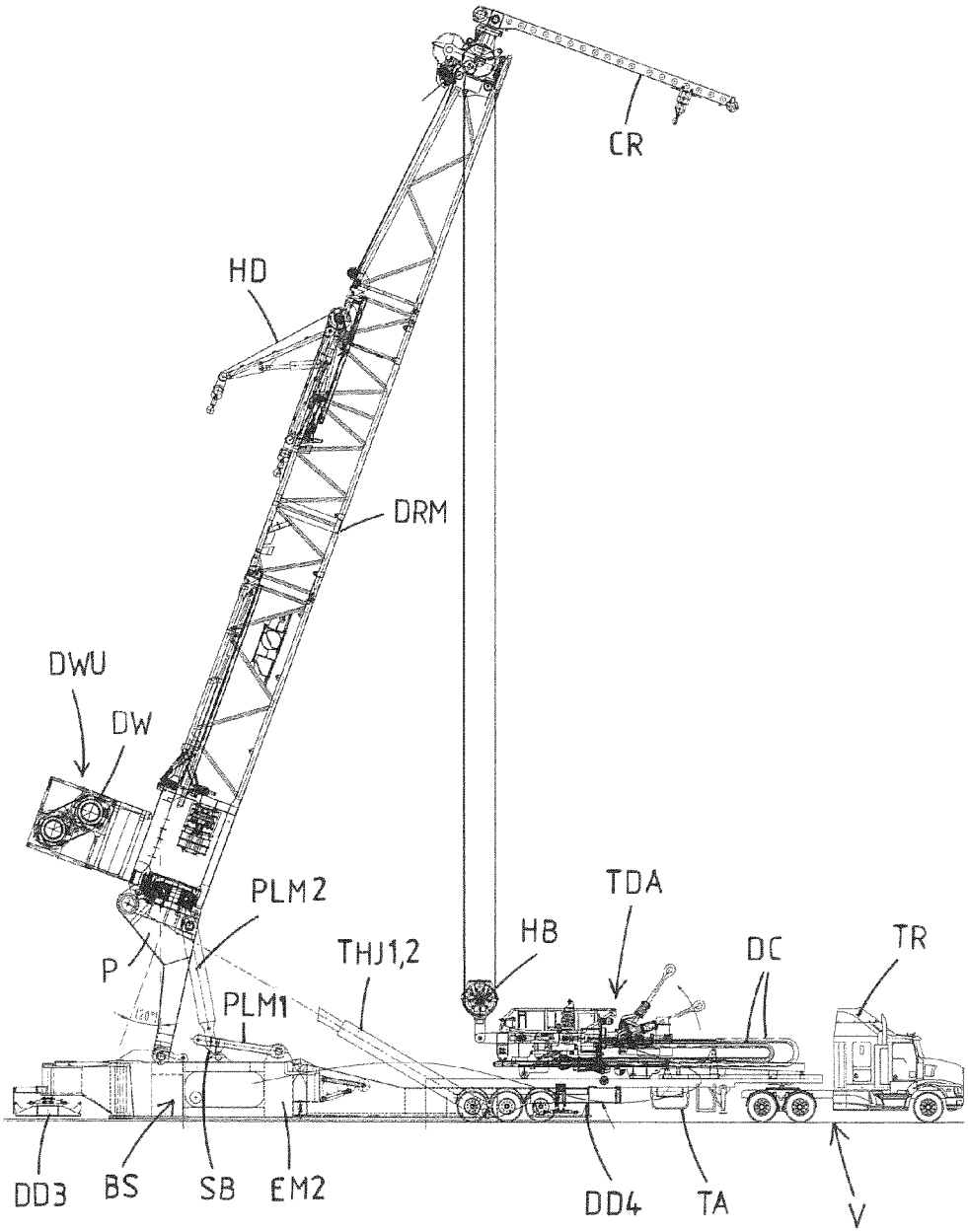
FIGS. 21-25 depict the installation of a top drive into the drilling rig mast of a modular drilling rig system according to another embodiment of the invention.

FIG. 21 depicts a modular drilling rig system comprising multiple components, which system is transfigurable between a transport mode in which the components of the system are transportable by vehicles and an operational mode in which the components are assembled to a drilling rig which is adapted to drill into a well centre in the ground, the system comprising a drilling rig mast DRM, a base structure BS to support the drilling rig mast DRM thereon, and a displacement system to displace the drilling rig.

The modular drilling rig system is similar to the modular drilling rig system described in the FIGS. 1-20, and the state of FIG. 21 is comparable to the state of FIG. 15. FIG. 21 depicts a vehicle V, i.e. a truck TR with trailer TA, on which a top drive assembly TDA is lying. The vehicle V is able to be received in a spacing of the base structure in between two elongated members of which only one is visible and indicated by reference numeral EM2.

The drilling rig mast is in a tilted position and supported by support blocks SB via first and second parts PLM1, PLM2 of a passive locking mechanism.

The top drive assembly TDA preferably comprises a framework, guide rails connected to the framework to be aligned with guide rails already present in the drilling rig mast, a trolley temporarily connected to the framework or guide rails for assembly reasons and configured for movement along the guide rails on the framework and drilling rig mast in the operational position of the drilling rig mast, and drag chains DC for connecting the top drive to other drilling equipment.

Figure 22:
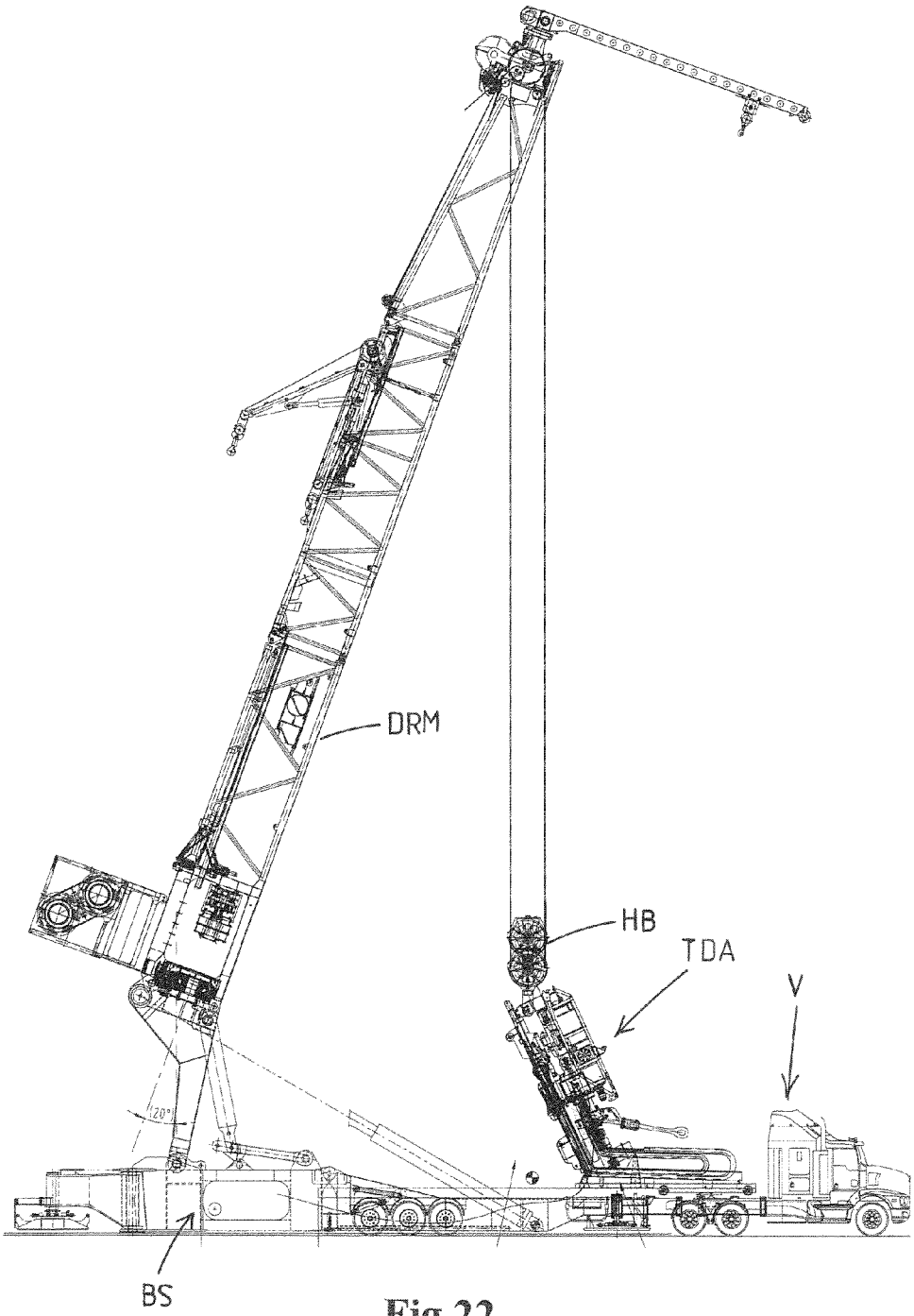
Figure 23:
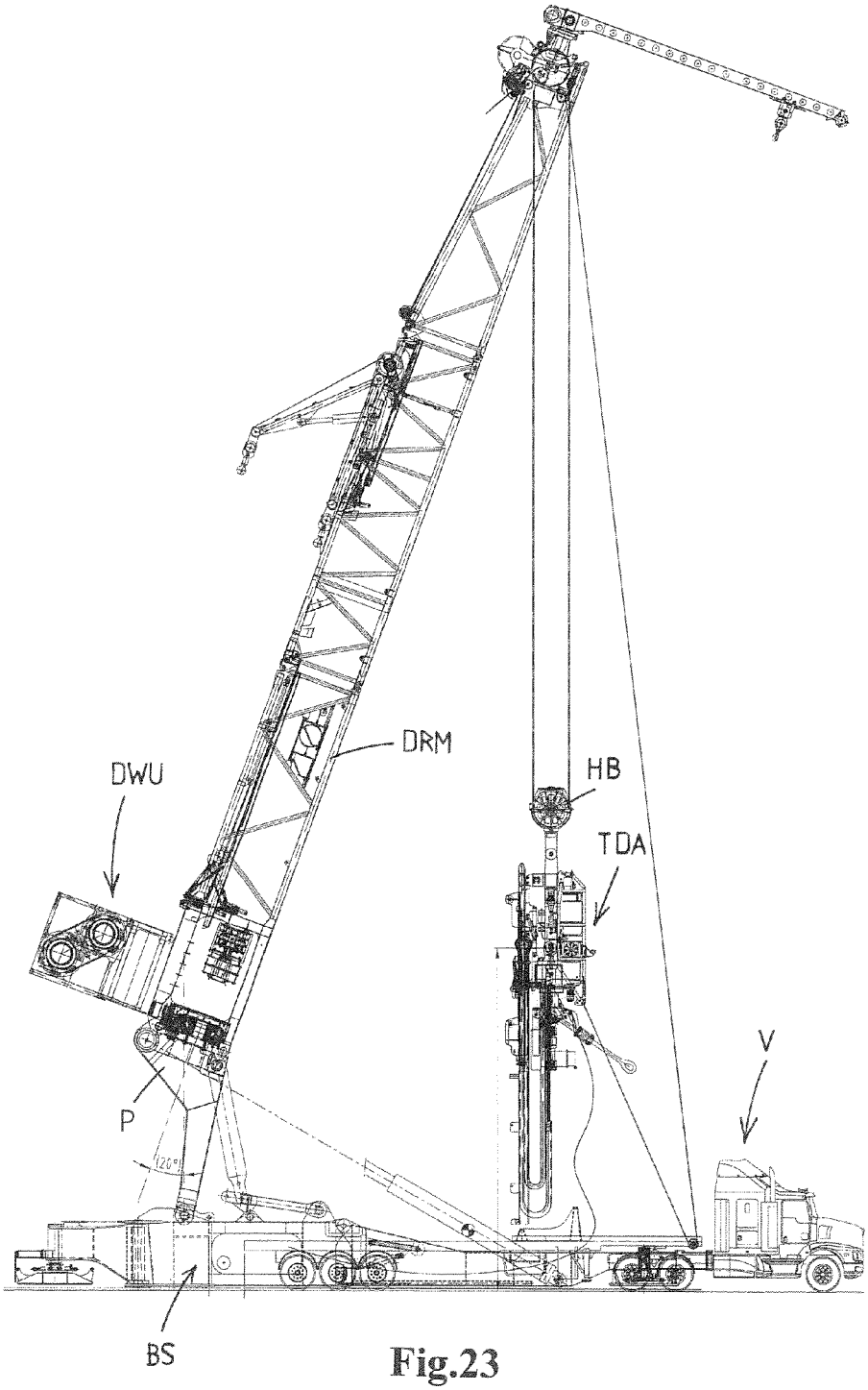

A hoist block HB which is suspended from the drawworks DW is lowered to the top drive assembly for connecting to the top drive assembly TDA. Lifting of the top drive assembly is done simultaneously with driving the vehicle V in a rearward direction, i.e. towards the drilling rig mast as shown in FIGS. 22 and 23.

Figure 24:
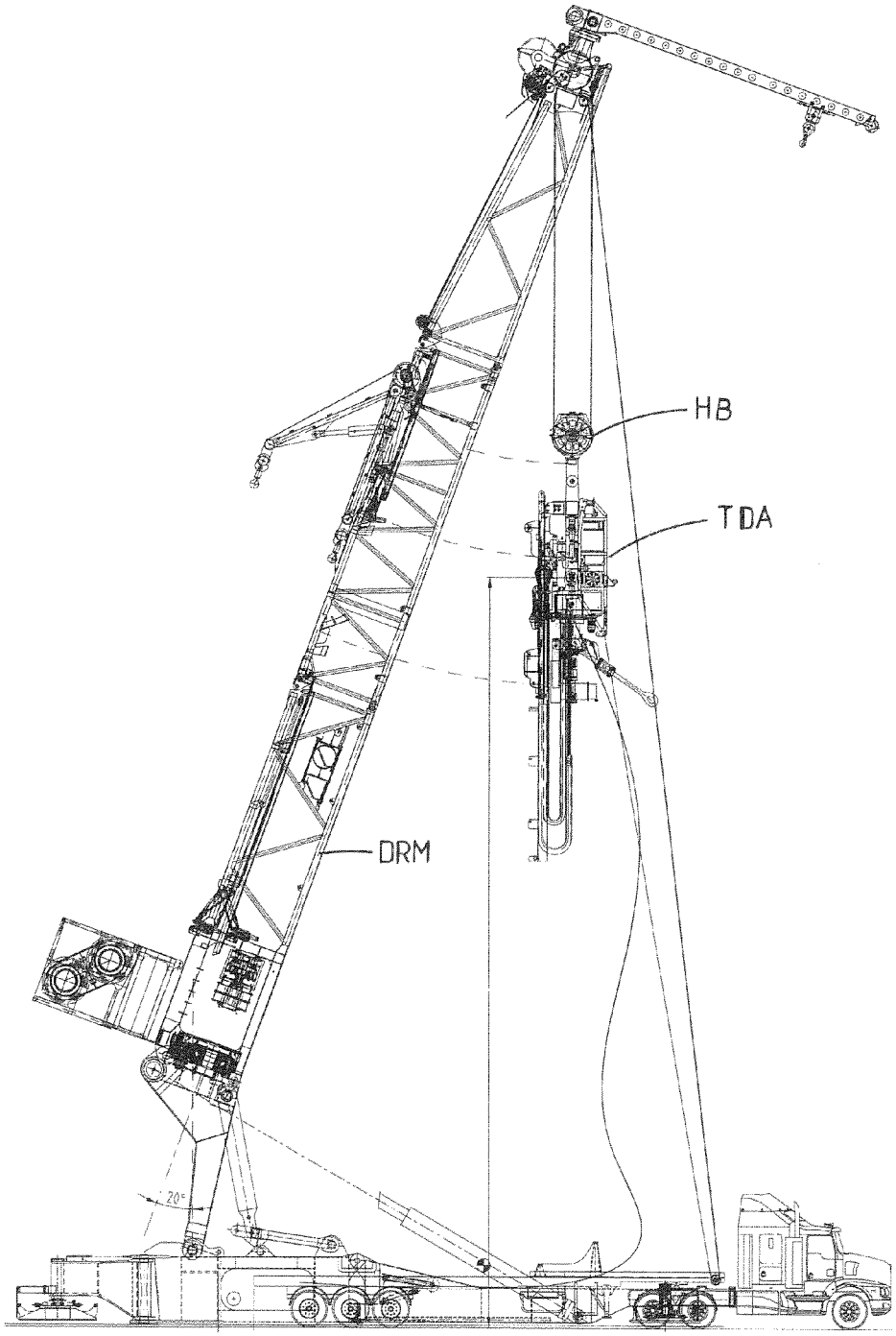
Figure 25:
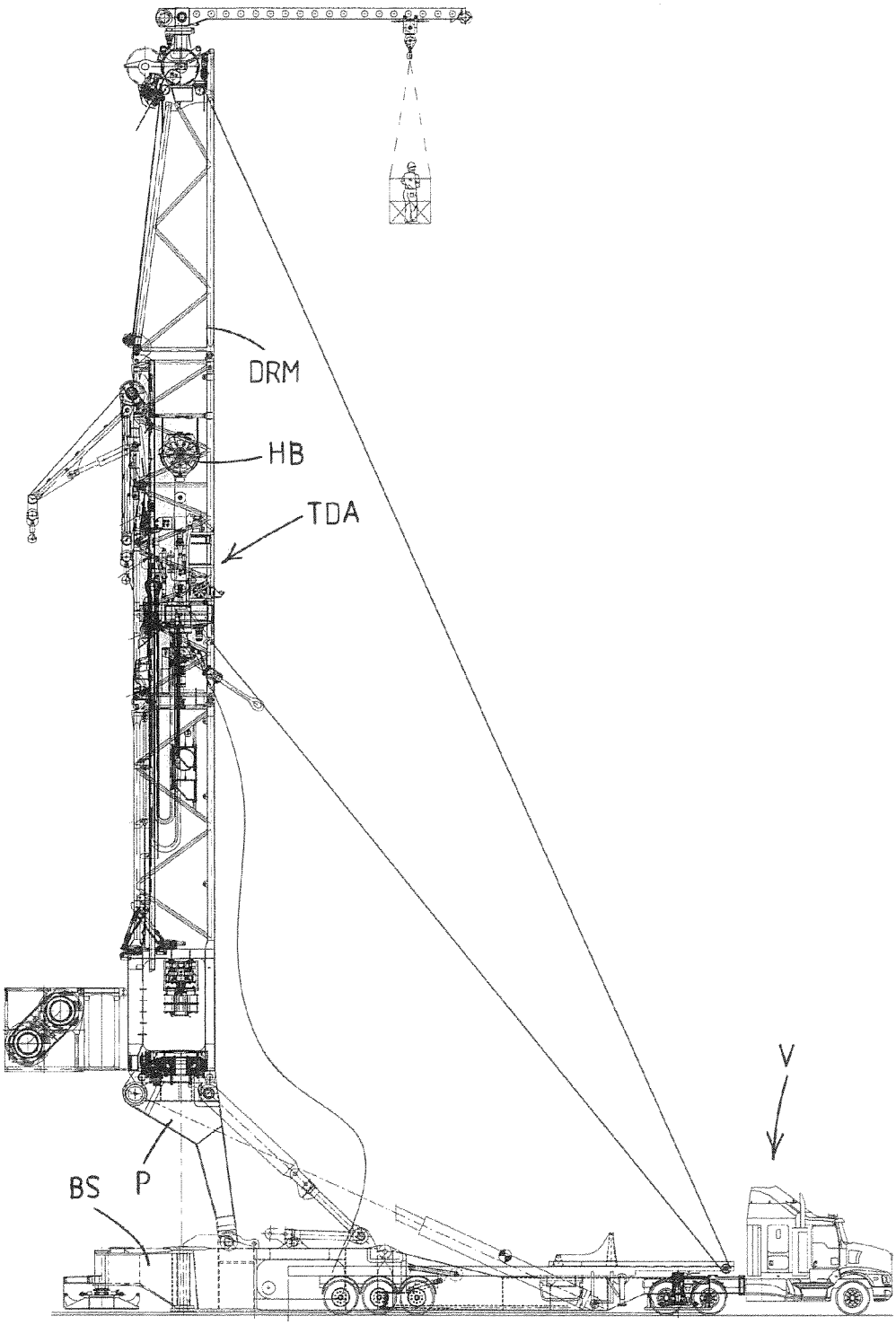

In FIG. 24, the top drive assembly is hoisted to a desired position, i.e. height, such that tilting to the vertical position of the drilling rig mast results in the top drive assembly being received in the space within the contours of the drilling rig mast as depicted in FIG. 25.

The embodiment of the top drive assembly and corresponding assembling method may be in accordance with the schematic embodiment shown in FIGS. 26-29.

Figure 26:
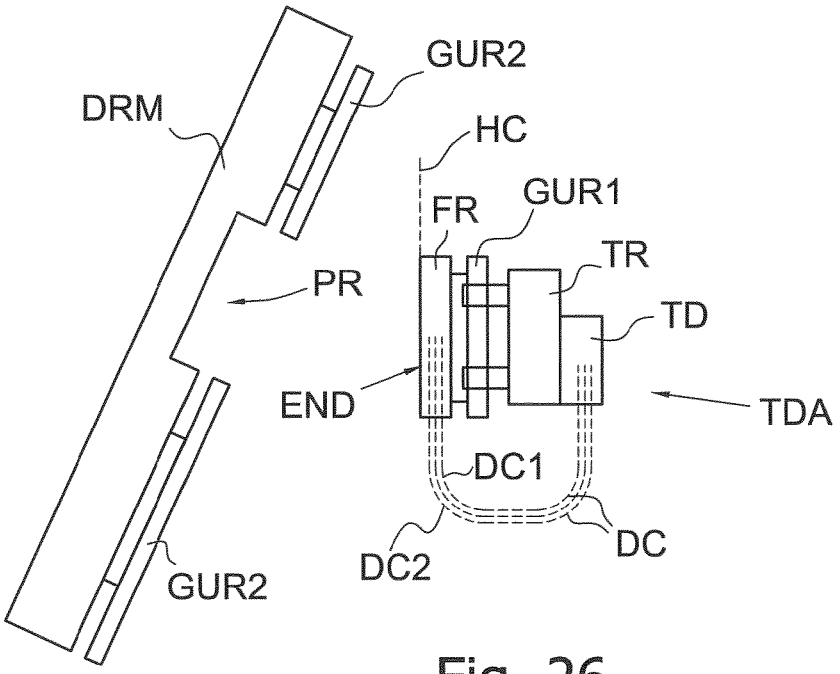
FIGS. 26-29 depict a simplified sequence of installing a top drive assembly into a drilling rig mast of a modular drilling rig mast according to yet another embodiment of the invention.

In FIG. 26, the drilling rig mast DRM is shown in a tilted intermediate position comparable to the position of the drilling rig mast DRM in FIG. 24. The drilling rig mast of FIG. 26 is provided with guide rails GUR2 which are assembled along with the corresponding mast sections (not shown).

FIG. 26 also shows a top drive assembly TDA comprising a frame portion FR, guide rails GUR1, trolley TR, top drive TD and drag chains DC.

The top drive assembly is suspended by a hoisting cable HC being part of drawworks (not shown). The position of the top drive assembly relative to the drilling rig mast is similar to the embodiment of FIG. 24.

Figure 27:
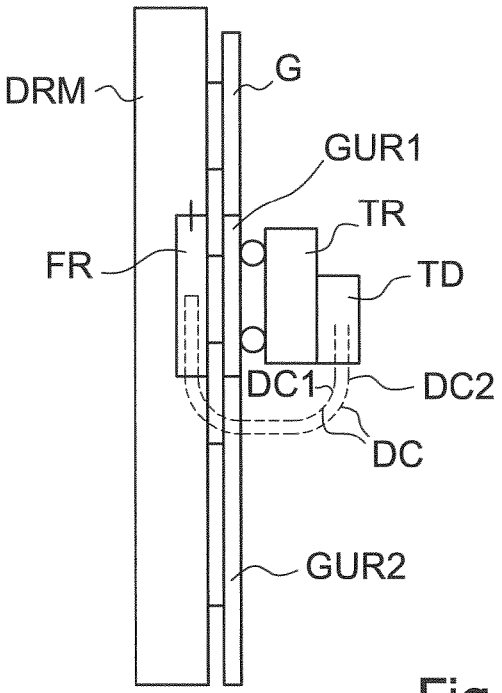

The drilling rig mast comprises provisions PR, e.g. in the form of recesses or cavities, for receiving the frame portion FR when the drilling rig mast is tilted to a substantially vertical operational position as shown in FIG. 27.

The guide rails GUR1 are connected to the frame portion FR to be aligned with the guide rails GUR2 of the drilling rig mast DRM in FIG. 27. In FIG. 26, the trolley TR is temporarily stationary connected to the guide rails GUR1. Once positioned in the drilling rig mast, this temporarily connection can be removed, so that the trolley is moveable along the guide rails GUR1, GUR2.

The top drive TD is connected to the trolley to be moved along with the trolley. In order to connect the top drive to other drilling equipment, the top drive assembly comprises drag chains DC, in particular a first drag chain DC1 and a second drag chain DC2.

The first and second drag chains are connected to each other with respective ends and with said respective ends to the frame portion FP as indicated by reference symbol END. The first drag chain is connected with its other end to the top drive, and the second drag chain is connected with its other end to first drag chain for transport and assembly purposes.

Figure 28:
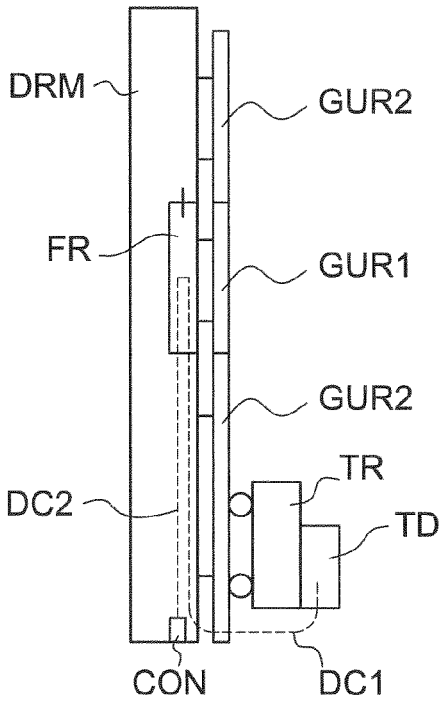
Figure 29:
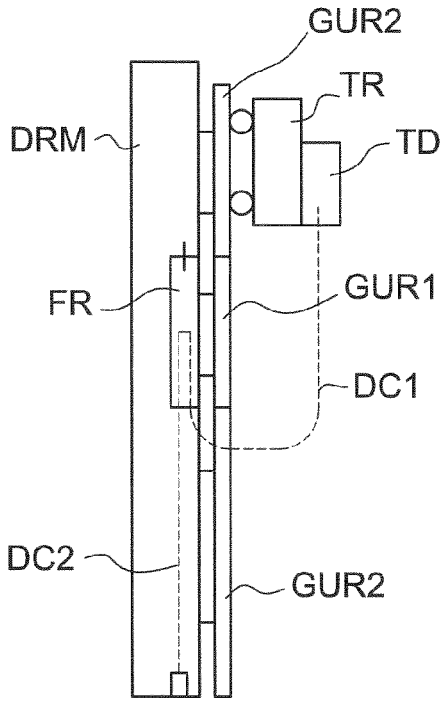

In FIG. 26, the drag chains are shown in solid lines. In FIGS. 27-29, the drag chains are shown by dotted lines for simplicity reasons. The free end of the second drag chain may alternatively be connected to the top drive.

In FIG. 27, the frame portion is received in the drilling rig mast and rigidly connected thereto. This also aligns the guide rails GUR1 with the guide rails GUR2 already present in the drilling rig mast to allow the trolley to move along the guide rails GUR1 and GUR2.

In order to connect the top drive to other drilling equipment, the trolley is moved to the foot of the drilling rig mast as shown in FIG. 28, where the second drag chain is connected at the foot of the drilling rig mast to the other drilling equipment using connection CON, so that the top drive is connected to the other drilling equipment via the first and second drag chain.

FIG. 29 shows how the trolley can also move to the top of the drilling rig mast, where the top drive TD is still connected to the other drilling equipment via the first and second drag chain.

Although the invention has been described by reference to embodiments in which different aspects of the invention may be combined, it will be clear to the skilled person that the invention can also be applied to other embodiment, where not all features have to be combined, and in which features may advantageously be isolated from the described embodiment while still falling within the scope of the invention.

The invention claimed is:

1. A modular drilling rig system comprising multiple components, which system is transfigurable between a transport mode in which the components of the system are transportable by vehicles and an operational mode in which the components are assembled to a drilling rig which is adapted to drill into a well center in the ground, the system comprising:

a drilling rig mast which is movable between a substantially horizontal connecting position and a substantially vertical operational position in which the drilling rig mast is positionable in a substantially vertical orientation above the well center;

a base structure adapted to be positioned in the operational mode on a surface near the well center to support the drilling rig mast thereon, wherein the base structure comprises two elongated members that are connected to each other by a cross beam in the operational mode; and a displacement system to displace the drilling rig in the operational mode with respect to the surface in a substantially horizontal direction, wherein the drilling rig mast comprises multiple transportable mast sections that need to be assembled end-to-end to form the drilling rig mast, wherein the two elongated members and the cross beam together form an H-arrangement when seen from above, with legs of the H-arrangement at a side remote from the well center being longer than legs of the H-arrangement at a side of the well center, or the two elongated members and the cross beam together form a C arrangement when seen from above with legs of the C arrangement at the side remote from the well center, such that the two elongated members at the side remote from the well center extend side-by-side with a spacing there between to assemble or disassemble the drilling rig mast in the substantially horizontal connecting position, and such that the well center is freely accessible, wherein the displacement system is configured to displace the two elongated members of the base structure together in order to displace the drilling rig in the operational mode, and the displacement system is configured such that the two elongated members can be displaced with respect to each other when the two elongated members are not connected to each other by the cross beam, and wherein:

the two elongated members and the cross beam together form an H-arrangement when seen from above, the legs of the H-arrangement at the side remote from the well center are separated from each other without any connection for a first length from the cross beam to distal ends of the legs of the H-arrangement at the side remote from the well center, and the legs of the H-arrangement at the side of the well center are separated from each other without any connection for a second length from the cross beam to distal ends of the legs of the H-arrangement at the side of the well center, the first length being greater than the second length.

2. The system according to claim 1, wherein the displacement system and the base structure are configured such that the two elongated members can be displaced with respect to each other when the two elongated members are not connected to each other by the cross beam in order to connect the two elongated members to each other by the cross beam.

3. The system according to claim 2, wherein axial ends of the cross beam are connectable to respective sides of the two elongated members of the base structure.

4. The system according to claim 2, wherein the elongated members each consist of two parts, each part being provided with a displacement device of the displacement system.

5. A method for bringing into operational mode the modular transfigurable drilling rig system according to claim 2, said method comprising the steps of:

a. positioning a first elongated member on the surface near the well center;

b. connecting the cross beam to the first elongated member;

c. positioning a second elongated member adjacent the combination of the first elongated member and the cross beam;

d. providing a displacement system that allows to move the first and second elongated members independently from each other as long as the first and second elongated members are not connected to each other;

e. moving the first and second elongated members relative to each other using the displacement system for connecting the second elongated member to the first elongated member by the cross beam; and f. connecting the second elongated member to the cross beam.

6. The system according to claim 1, wherein axial ends of the cross beam are connectable to respective sides of the two elongated members of the base structure.

7. The system according to claim 6, wherein the elongated members each consist of two parts, each part being provided with a displacement device of the displacement system.

8. A method for bringing into operational mode the modular transfigurable drilling rig system according to claim 6, said method comprising the steps of:

a. positioning a first elongated member on the surface near the well center;

b. connecting the cross beam to the first elongated member;

c. positioning a second elongated member adjacent the combination of the first elongated member and the cross beam;

d. providing a displacement system that allows to move the first and second elongated members independently from each other as long as the first and second elongated members are not connected to each other;

e. moving the first and second elongated members relative to each other using the displacement system for connecting the second elongated member to the first elongated member by the cross beam; and f. connecting the second elongated member to the cross beam.

9. The system according to claim 1, wherein the elongated members each consist of two parts, each part being provided with a displacement device of the displacement system.

10. A method for bringing into operational mode the modular transfigurable drilling rig system according to claim 9, said method comprising the steps of:

a. positioning a first elongated member on the surface near the well center;

b. connecting the cross beam to the first elongated member;

c. positioning a second elongated member adjacent the combination of the first elongated member and the cross beam;

d. providing a displacement system that allows to move the first and second elongated members independently from each other as long as the first and second elongated members are not connected to each other;

e. moving the first and second elongated members relative to each other using the displacement system for connecting the second elongated member to the first elongated member by the cross beam; and f. connecting the second elongated member to the cross beam.

11. A method for bringing into operational mode the modular transfigurable drilling rig system according to claim 1, said method comprising the steps of:

a. positioning a first elongated member on the surface near the well center;

b. connecting the cross beam to the first elongated member;

c. positioning a second elongated member adjacent the combination of the first elongated member and the cross beam;

d. providing a displacement system that allows to move the first and second elongated members independently from each other as long as the first and second elongated members are not connected to each other;

e. moving the first and second elongated members relative to each other using the displacement system for connecting the second elongated member to the first elongated member by the cross beam; and f. connecting the second elongated member to the cross beam.

12. The system according to claim 1, further including a pedestal adapted to be, in a substantially horizontal connecting position thereof, pivotally connected at a lower end thereof to said base structure about a pedestal pivot axis, the pedestal being operable to pivot between the substantially horizontal connecting position and a substantially vertical operational position, and the pedestal being adapted to be, in the substantially horizontal connecting position, connected to a foot of the drilling rig mast and adapted to, in the substantially vertical operational position, support the drilling rig mast above the well center.

13. The system according to claim 12, wherein the pedestal is pivotally connected to the two elongated members of the base structure.

14. The system according to claim 1, wherein the cross beam is made out of one piece.

15. The system according to claim 1, further comprising a pipe loader for loading pipes into the drilling rig mast.

16. The system according to claim 15, wherein the spacing is dimensioned to receive the pipe loader when the drilling rig mast is in the substantially vertical position.

17. The system according to claim 1, further comprising a passive locking mechanism to lock the position of the drilling rig mast in the substantially vertical orientation relative to the base structure.

18. The system according to claim 1, wherein the drilling rig mast is positioned directly between the legs of the H-arrangement at the side remote from the well center in the substantially horizontal connecting position.

19. The system according to claim 1, wherein:

the two elongated members and the cross beam together form an H-arrangement when seen from above, and each distal end of the legs of the H-arrangement at the side remote from the well center and the legs of the H-arrangement at the side of the well center is provided with a displacement device movably, with respect to the respective distal end, connected to the respective distal end.

20. A modular drilling rig system comprising multiple components, which system is transfigurable between a transport mode in which the components of the system are transportable by vehicles and an operational mode in which the components are assembled to a drilling rig which is adapted to drill into a well center in the ground, the system comprising:

a drilling rig mast which is movable between a substantially horizontal connecting position and a substantially vertical operational position in which the drilling rig mast is positionable in a substantially vertical orientation above the well center;

a base structure adapted to be positioned in the operational mode on a surface near the well center to support the drilling rig mast thereon, wherein the base structure comprises two elongated members that are connected to each other by a cross beam in the operational mode; and a displacement system to displace the drilling rig in the operational mode with respect to the surface in a substantially horizontal direction, wherein the drilling rig mast comprises multiple transportable mast sections that need to be assembled end-to-end to form the drilling rig mast, wherein the two elongated members and the cross beam together form an H-arrangement when seen from above, with legs of the H-arrangement at a side remote from the well center being longer than legs of the H-arrangement at a side of the well center, or the two elongated members and the cross beam together form a C arrangement when seen from above with legs of the C arrangement at the side remote from the well center, such that the two elongated members at the side remote from the well center extend side-by-side with a spacing there between to assemble or disassemble the drilling rig mast in the substantially horizontal connecting position, and such that the well center is freely accessible, wherein the displacement system is configured to displace the two elongated members of the base structure together in order to displace the drilling rig in the operational mode, and the displacement system is configured such that the two elongated members can be displaced with respect to each other when the two elongated members are not connected to each other by the cross beam, and wherein the two elongated members and the cross beam together form an H-arrangement when seen from above, and each distal end of the legs of the H-arrangement at the side remote from the well center and the legs of the H-arrangement at the side of the well center is provided with a displacement device movably, with respect to the respective distal end, connected to the respective distal end.

* * * * *